United States Patent [19]

Pesheck et al.

[11] Patent Number: 4,970,360

[45] Date of Patent: Nov. 13, 1990

[54] SUSCEPTOR FOR HEATING FOODS IN A MICROWAVE OVEN HAVING METALLIZED LAYER DEPOSITED ON PAPER

[75] Inventors: Peter S. Pesheck, Brooklyn Center, Minn.; Craig Shevlin, Belo Horizonte, Brazil; Jonathan D. Kemske, White Bear, Minn.; Michael R. Perry, Plymouth, Minn.; Matthew W. Lorence, Bloomington, Minn.

[73] Assignee: The Pillsbury Company, Minneapolis, Minn.

[21] Appl. No.: 267,545

[22] Filed: Nov. 4, 1988

[51] Int. Cl.[5] ..... H05B 6/80

[52] U.S. Cl. ..... 219/10.55 E; 219/10.55 F; 426/107; 426/234; 426/243; 99/DIG. 14; 126/390

[58] Field of Search ..... 219/10.55 E, 10.55 F, 219/10.55 R; 426/107, 109, 111, 112, 113, 114, 243, 241, 234; 99/DIG. 14, 451; 126/390

[56] References Cited

U.S. PATENT DOCUMENTS

| | | | |
|---|---|---|---|
| 3,865,301 | 2/1975 | Pothier et al. | 99/DIG. 14 |
| 4,267,420 | 5/1981 | Brastad | 219/10.55 E |
| 4,641,005 | 2/1987 | Seiferth | 219/10.55 E |
| 4,713,510 | 12/1987 | Quick et al. | 219/10.55 E |
| 4,735,513 | 4/1988 | Watkins et al. | 426/113 X |
| 4,785,160 | 11/1988 | Hart | 99/DIG. 14 |
| 4,800,247 | 1/1989 | Schneider et al. | 219/10.55 E |

FOREIGN PATENT DOCUMENTS

| | | |
|---|---|---|
| 0063108 | 10/1982 | European Pat. Off. . |
| 0161739 | 11/1985 | European Pat. Off. . |
| 0205304 | 12/1986 | European Pat. Off. . |
| 0244179 | 11/1987 | European Pat. Off. . |
| 2166554 | 8/1973 | France . |
| WO88/05249 | 7/1988 | PCT Int'l Appl. . |

OTHER PUBLICATIONS

Marks' Standard Handbook for Mechanical Engineers,. (8th ed. 1978), pp. 6-36, 6-37.

*Primary Examiner*—Philip H. Leung
*Attorney, Agent, or Firm*—Arnold, White & Durkee

[57] ABSTRACT

A susceptor for heating a food substance in a microwave oven is disclosed which has a thin film of metal deposited on a dimensionally stable dielectric substrate, such as paper. Substrate having a rough surface may be used. Preferably, the susceptor has a complex impedance measured prior to heating, at the frequency of the microwave oven, which has a real part between 30 and 2000 ohms per square. The preferred thickness of the thin metal film is related to the smoothness of the paper substrate. A substrate having a surface smoothness, expressed as an arithmetic average roughness, greater than 0.5 microns may be used with the present invention. The metal film is preferably aluminum having a thickness between 50 Angstroms and 600 Angstroms. The substrate may be coated with coatings such as clay. Clay coated paper substrates having a thin film of metal deposited thereon exhibit improved stability of performance characteristics during microwave heating.

32 Claims, 11 Drawing Sheets

Fig.14
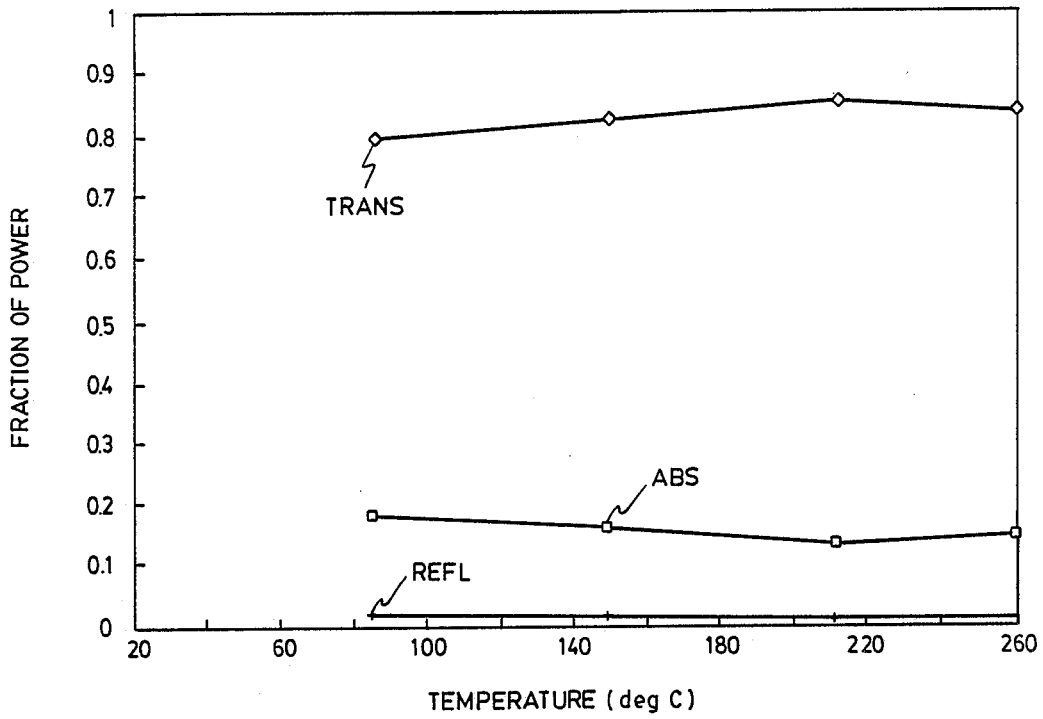
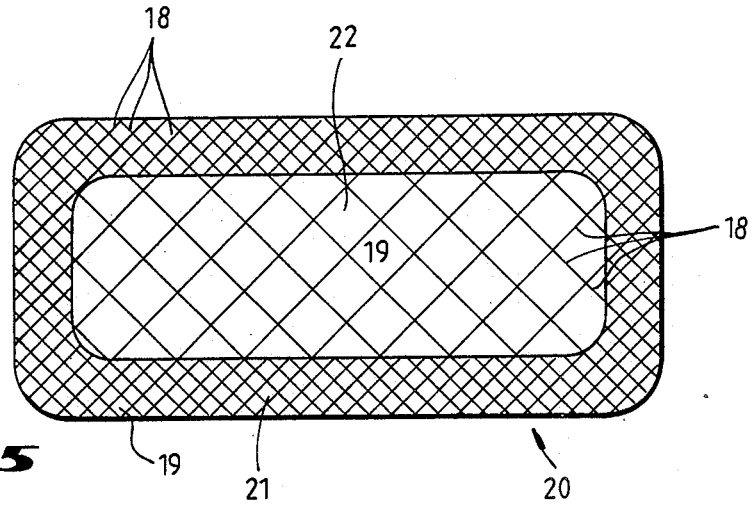
Fig.15

SUSCEPTOR FOR HEATING FOODS IN A MICROWAVE OVEN HAVING METALLIZED LAYER DEPOSITED ON PAPER

CROSS-REFERENCE TO RELATED APPLICATION

This application discloses subject matter related to application Ser. No. 197,634, filed May 23, 1988, by Kemske et al., for "Susceptors Having Disrupted Regions For Differential Heating In A Microwave Oven", the entire disclosure of which is incorporated herein by reference.

BACKGROUND OF THE DISCLOSURE

Microwave heating of foods in a microwave oven differs significantly from conventional heating in a conventional oven. Conventional heating involves surface heating of the food by energy transfer from a hot oven atmosphere. In contrast, microwave heating involves the absorption of microwaves which may penetrate significantly below the surface of the food. In a microwave oven, the oven atmosphere will be at a relatively low temperature. Therefore, surface heating of foods in a microwave oven can be problematical.

A susceptor is a microwave responsive heating device that is used in a microwave oven for purposes such as crispening the surface of a food product or for browning. When the susceptor is exposed to microwave energy, the susceptor gets hot, and in turn heats the surface of the food product.

Conventional susceptors have a thin layer of polyester, used as a substrate, upon which is deposited a thin metallized film. For example, U.S. Pat. No. 4,641,005, issued to Seiferth, discloses a conventional metallized polyester film-type susceptor which is bonded to a sheet of paper. Herein, the word "substrate" is used to refer to the material on which the metal layer is directly deposited, e.g., during vacuum evaporation, sputtering, or the like. A biaxially oriented polyester film is the substrate used in typical conventional susceptors. Conventional metallized polyester film cannot, however, be heated by itself or with many food items in a microwave oven without undergoing severe structural changes: the polyester film, initially a flat sheet, may soften, shrivel, shrink, and eventually may melt during microwave heating. Typical polyester melts at approximately 220–260° C.

Conventional polyester film has been thought to be necessary as a substrate in order to provide a suitable surface upon which a metal film may be effectively deposited.

In order to provide some stability to the shape of the susceptor, a metallized layer of polyester is typically bonded to a sheet of paper or paperboard. Usually, the thin film of metal is positioned at the adhesive interface between the layer of polyester and the sheet of paper.

During heating, it has been observed that metallized polyester will tend to break up during heating, even when the metallized polyester is adhesively bonded to a sheet of paper. Such breakup of the metallized polyester layer reduces the responsiveness of the susceptor to microwave heating. It has been observed that some areas of a conventional susceptor may initially heat substantially when exposed to microwave radiation, and then the heating effects of microwave radiation will appear to reduce. The responsiveness of those areas of the susceptor to microwave radiation decreases significantly as a result of breakup.

In the past, effective crispening and browning of a food surface using a conventional susceptor has been impeded because the metallized polyester layer presents a moisture impermeable food contact surface which inhibits the release of steam. Many foods release grease and water during heating. Trapped steam, water and fat between the food surface and the substantially moisture impermeable metallized polyester susceptor surface has an adverse effect upon crispening of the food surface.

Conventional susceptors are relatively costly to produce due to the multiple steps involved. First, a polyester layer is coated with a thin film of metal. Then this metallized polyester sheet is adhesively bonded to paper or paperboard. In some cases, this composite structure is further laminated to a final package.

U.S. Pat. No. 4,735,513, issued to Watkins et al., discloses an attempt to use backing sheets in addition to a coated susceptor substrate in order to maintain the structural integrity of the susceptor. U.S. Pat. No. 4,267,420, issued to Brastad, discloses a flexible susceptor film which includes a thin metal film on a dielectric substrate such as thin polyester. This thin structure may then be supported by more rigid dielectric material such as paperboard. U.S. Pat. No. 4,705,929, issued to Atkinson, discloses a rigid microwave tray and method for producing such a tray. A microwave interactive layer of material is provided on the upper face of the tray. None of these patents disclose a metallized layer deposited directly on a paper substrate.

It will be apparent from the above discussion that prior attempts to achieve a cost-effective metallized susceptor have not been altogether satisfactory.

SUMMARY OF THE INVENTION

In accordance with the present invention, a susceptor for heating a food substance in a microwave oven is provided which has a thin film of metal deposited on a dimensionally stable paper substrate. Other rough substrates may be used. The susceptor should have a complex impedance measured prior to heating, at the frequency of the microwave oven, which has a real part of the impedance, most preferably between 30 and 2000 ohms per square for typical loads. A substrate such as paper may be used which has a surface that is much less smooth than what has been heretofore thought to be required for a substrate. A substrate having a surface smoothness, which may be expressed as an arithmetic average roughness, measured to be greater than 0.5 microns, may be used with the present invention. The preferred thickness of the thin film of metal is interrelated to the conductivity of the metal and the smoothness of the paper substrate. The metal film is preferably aluminum having a thickness between 50 Angstroms and 600 Angstroms.

BRIEF DESCRIPTION OF THE DRAWINGS

For a more complete understanding of the present invention, reference should be had to the following detailed description taken in conjunction with the drawings, in which:

FIG. 14 is a graph depicting absorption, reflection and transmission measurements versus temperature for a rapidly heating susceptor constructed in accordance with the present invention.

FIG. 15 is a top view of a susceptor constructed in accordance with the present invention having disruptions to the continuity of the thin metal film.

DETAILED DESCRIPTION OF A PREFERRED EMBODIMENT OF THE INVENTION

Figure 1:
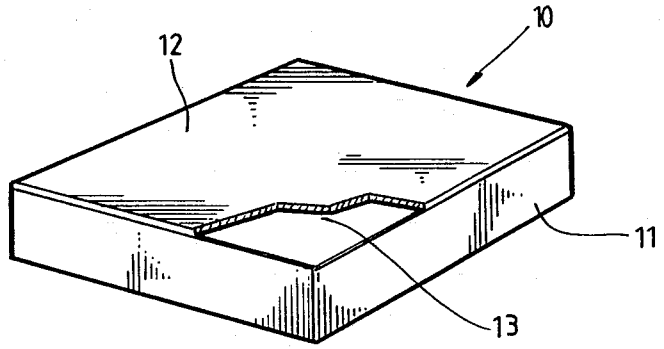
FIG. 1 is a partially cutaway perspective view of a susceptor constructed in accordance with the present invention.
Figure 2:
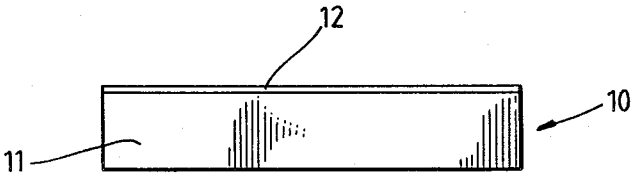
FIG. 2 is a cross-sectional side view of a susceptor constructed in accordance with the present invention.

FIG. 1 illustrates a susceptor 10 for heating the surface of a food product in a microwave oven. The susceptor 10 has a paper substrate 11. The paper substrate 11 is preferably dimensionally stable. That is, the substrate 11 substantially maintains its shape, structural integrity, and dimensions in both length and width during microwave heating. This is an advantage over polyester substrates which tend to shrink and shrivel during microwave heating, if not adhesively bonded to a stable material.

The paper substrate 11 may be a flexible paper sheet. Alternatively, the paper substrate 11 may be a rigid sheet of paper or paperboard.

In accordance with the present invention, the substrate 11 may be made from fibrous material such as paper. Under a microscope, the surface 13 of a sheet of paper 11 may appear rough, with microscopic hills and valleys. As will be explained more fully herein, the degree of roughness of the paper substrate 11 is an important determinant of the susceptor electrical properties.

In accordance with the present invention, a thin layer of metal film 12 is deposited on the surface 13 of the paper substrate 11. In the illustrated embodiment, the thin layer of metal film 12 is deposited directly on the surface 13 of the paper substrate 11.

For purposes of the present invention, the "thickness" of the thin metal film is defined as follows. The thickness of the metal layer is determined during deposition using a Inficon Model XTC crystal thickness monitor. The monitor utilizes a 6 MHz plano-convex quartz crystal whose frequency of oscillation varies as a function of the amount of metal deposited upon it, the density of the metal, and the modulus of elasticity in shear of the deposited metal. The monitor may be preprogrammed with the values of these constants for the material to be deposited. A tooling factor, which specifies the ratio of thickness at the substrate holder to the thickness at the quartz crystal is also preprogrammed and assures that the thickness reported by the thickness monitor is that of the deposit on the substrate holder.

Accurate calibration is accomplished by measuring the thickness of the deposit on the substrate by independent means. Typically, a profilometer or optical spectrometer is employed for verification of calibration of thickness reported by the crystal monitor.

The metal film thicknesses herein refer to the film thickness deposited on the smooth face of the crystal monitor. The actual thickness deposited on the less-regular paper substrate surface probably varies from point to point and would be extremely difficult to measure accurately. The metal thicknesses reported by the crystal monitor are believed to be reproducible to within about ±10%.

The thickness of the metal film 12 is critical to the successful operation of the susceptor 10. If the metal film 12 is made too thin, the susceptor 10 will not heat adequately in response to microwave radiation. If the metal film 12 is made too thick, the susceptor 10 will suffer from the problem of arcing. Thus, the thickness of the metal film 12 has an upper limit due to arcing, and a lower limit which is insufficient to cause adequate heating of the food. A thickness which falls in the range between these two extremes will provide satisfactory results in practice. However, the upper and lower limits of the range are affected by the smoothness of the surface 13 of the paper substrate 11, and also by the composition of the metal which is deposited in forming the metal film 12.

For a thin metal film 12 of aluminum, the thickness should preferably be between 50 Angstroms and 600 Angstroms.

If the surface 13 of the paper substrate 11 is extremely smooth, a thinner metal film 12 will be operable to provide adequate heating. If the surface 13 of the paper substrate 11 is less smooth, a slightly thicker metal film 12 will be necessary before adequate heating will be observed. A similar fact is observed for the thickness of the metal film 12 which produces arcing. A thinner metal film 12 will result in arcing for a smoother surface 13 as compared with a less smooth surface 13 of the paper substrate 11. Therefore, the range of thicknesses for the metal film 12 which will provide satisfactory results in practice will be shifted downwardly for a smoother surface 13 as compared with a less smooth surface 13 of the paper substrate 11.

The heating performance of the susceptor is dependent upon the thickness of the metal film 12 and the smoothness of the surface 13. The best way to predict the heating performance of a susceptor is by measuring the impedance of the susceptor using a network analyzer. The impedance is a complex number having a reactive part or imaginary part, and having a resistive part or real part. Of particular interest is the resistive or real part of the surface impedance of the susceptor. A thinner metal film 12 will have a higher resistive component to its impedance.

The impedance of the susceptor must be measured at the frequency of the microwave oven. For microwave ovens commonly in use, the frequency is 2450 MHz. In the past, surface resistance of a susceptor has been measured under direct current conditions. While such measurements may have been useful in characterizing thin film susceptors deposited directly on polyester, such measurement techniques are inadequate for the present invention. Some metal coatings may appear discontinuous when measured with direct current, while being operative for purposes of the present invention. Therefore, all impedances, and surface resistances, specified in the present application for the present invention refer to measurements made at the frequency of the microwave oven, which in all cases is 2450 MHz unless otherwise stated. Resistive components of the complex impedance measured at the frequency of the microwave oven may differ significantly from surface resistivities measured under direct current conditions. It is generally believed that the prior art fails to recognize the need to characterize a susceptor comprising a thin film of metal deposited directly on a paper substrate by measuring the complex impedance at the frequency of the microwave oven.

A lower limit for the resistive component of the complex impedance of the susceptor is determined by the desire to avoid arcing. This relates to the maximum thickness for the metal film 12. The lower limit for the resistive component of the impedance of the susceptor is dependent upon the metal comprising the conductive film and upon the smoothness of the surface 13 of the paper substrate 11. A resistive component less than 30 ohms/square should be avoided, because arcing has been observed in practice where the metal film 12 was made of aluminum and the resistive component was less than 30 ohms/square. Where the resistive component is between about 30 ohms/square and about 125 ohms/square, for aluminum, arcing is dependent upon the substrate 11. Where the resistive component is greater than 125 ohms/square, no arcing was observed for metal films 12 made of aluminum. Measurement of the resistive component is made prior to microwave heating.

The upper limit for the resistive component of the impedance of the susceptor is dependent upon heating efficacy. Where the resistive component of the impedance is too high, the susceptor will not adequately heat. A resistive component less than about 35,000 ohms/square is preferred. A resistive component less than about 14,500 ohms/square is more preferred. A resistive component less than about 7,000 ohms/square is even more preferred. A resistive component of about 4,500 ohms/square is especially preferred. A resistive component of the impedance of the susceptor less than about 3,300 ohms/square is more especially preferred. A resistive component of the impedance of the susceptor less than about 2000 ohms/square is most especially preferred.

Alternatively, absorption may be measured with a network analyzer to determine the minimum thinness of the metal film 12. An absorption greater than about 1% is preferred. An absorption greater than about 2.5% is more preferred. An absorption greater than about 5% is even more preferred. An absorption greater than about 7.5% is especially preferred. An absorption, as measured with a network analyzer, greater than about 10% is most especially preferred. The value of absorption may be tailored to the particular food product which is to be heated.

The discovery of the relationship between thickness of the metal film 12 and smoothness of the surface 13 of the paper substrate 11 has been significant in realizing a successful susceptor 10 in accordance with the present invention.

The metal film 12 is preferably made of aluminum. The metal film is applied using a suitable deposition process, including vacuum deposition, sputtering, E-beam, chemical vapor deposition, or combinations of these methods. Any method capable of depositing a thin film layer of metal unto a paper substrate may be used.

The metal film 12 may also be advantageously made of stainless steel. In the case of stainless steel, the metal film 12 preferably has a thickness between about 50 Angstroms and about 3500 Angstroms. The thickness of the metal film 12 is more preferably between about 100 Angstroms and about 3000 Angstroms, for stainless steel. Where stainless steel is used, the metal film 12 preferably has a complex impedance measured at the frequency of the microwave oven which has a resistive part between about 60 ohms/square to about 7000 ohms/square. The real part of the resistivity is more preferably between about 300 ohms/square to about 5000 ohms/square for stainless steel. For purposes of this invention, stainless steel includes any iron alloy having chromium included therein. This includes iron alloys sometimes referred to as rust-free or rust-resistant.

The metal film 12 may also be made of nickel, gold, tantalum, tungsten, silver, nichrome, titanium, oxides of titanium, oxides of vanadium, as well as other metals, metal oxides, and alloys. Other conductive materials may be used to produce a thin film which heats responsive to microwave radiation.

The substrate 11 preferably comprises cellulose fiber formed into a sheet. The substrate 11 should be a "microwave stable" material, that is, it should not significantly shrivel, shrink or melt during microwave heating for a predetermined period of time necessary to heat a food product. Rough substrates other than paper may be used. Paper sheets are considered herein to be paper substrates having a thickness less than about 0.0254 cm. Paperboard may include paper substrates which have a thickness greater than about 0.0254 cm. Various types of paper may be used, including SBS, SUS, sulfite, writing, parchment, news, as well as other types and grades of paper. The paper substrate 11 may include a coating or surface treatment, or filler, to enhance smoothness. Clay coatings have been used with satisfactory results. Clay coatings have been found to improve the stability of the electrical impedance of the susceptor during microwave heating, and are preferred where stability is an important design consideration. Coatings or surface treatments may also be used to enhance brightness or structural integrity. The finish on the surface 13 of the paper substrate 11 may be modified by calendering, chemical treatment, or lacquers.

Table I shows the relationship between the thickness of the metal film 12 and the measured resistive component of the surface impedance, as measured with a network analyzer, for various paper substrates and two examples of polyester substrates. The paper substrates 11 which were used included bond paper, copier paper, filter paper, parchment paper, and Westvaco clay coated paperboard. The two polyester substrates which were used were biaxially oriented polyester (BOPET) bonded to a support member, and polyester extruded onto paperboard (EXPET). The surface resistance was measured with a network analyzer prior to microwave heating. Each sample was then placed on the floor of a 700 watt microwave oven and heated for about 10 seconds. The samples which arced have an asterisk ("*") next to them in the table. It will be seen that all samples having a surface resistance less than about 29 ohms/square experienced arcing. No aluminum samples having a surface resistance greater than 125 ohms per square experienced arcing. Samples having a surface resistance between about 29 ohms per square and about 125 ohms per square may or may not have experienced arcing dependent upon the composition of the substrate 11. All the samples in Table I used aluminum for the metal film 12.

TABLE I

| Aluminum Thickness | | | Surface Resistance (ohms/square) | | | | |
|---|---|---|---|---|---|---|---|
| (Angstroms) | Bond | Copier | Filter | Parchment | Coated | BOPET | EXPET |
| 100 | 1136 | 1330 | 1454 | 1306 | 1953 | 174 | *37 |
| 200 | 261 | 168 | 767 | 497 | 117 | *14 | *10 |
| 300 | 100 | 164 | 363 | *100 | *24 | *7 | *7 |
| 400 | 44 | 70 | 199 | *37 | *25 | *2 | *3 |
| 500 | 29 | *21 | 58 | *33 | *8 | *3 | *2 |
| 600 | *15 | *18 | 31 | *33 | *9 | *3 | *2 |
| 700 | *8 | *9 | *16 | *11 | *9 | *2 | *2 |

It should be noted that at very small thicknesses of aluminum, a broad range of surface resistances are achievable with the present invention. This range has not been available for conventional susceptors, which used aluminum coated on smooth surfaced polyester films.

In the case of a metal film 12 composed of stainless steel, samples having a surface resistance less than about 110 ohms/square experienced arcing. Samples having a surface resistance between about 110 ohms/square and about 300 ohms/square may or may not have experienced arcing depending upon the composition of the substrate 11. No samples having a thin metal film of stainless steel experienced arcing where the surface resistance was greater than about 300 ohms/square.

In accordance with the present invention, substrates may be used which have a surface smoothness that is significantly rougher than conventional polyester film typically used for substrates. The roughness of a substrate may be expressed as an arithmetic average (AA) roughness, measured as hereinafter described. Substrates having an arithmetic average roughness greater than 0.2 microns have provided good results in accordance with the present invention. Substrates having an arithmetic average roughness greater than 0.5 microns are satisfactory. The present invention provides for the effective use of substrates having a much rougher surface than was previously thought to be possible.

Figure 4:
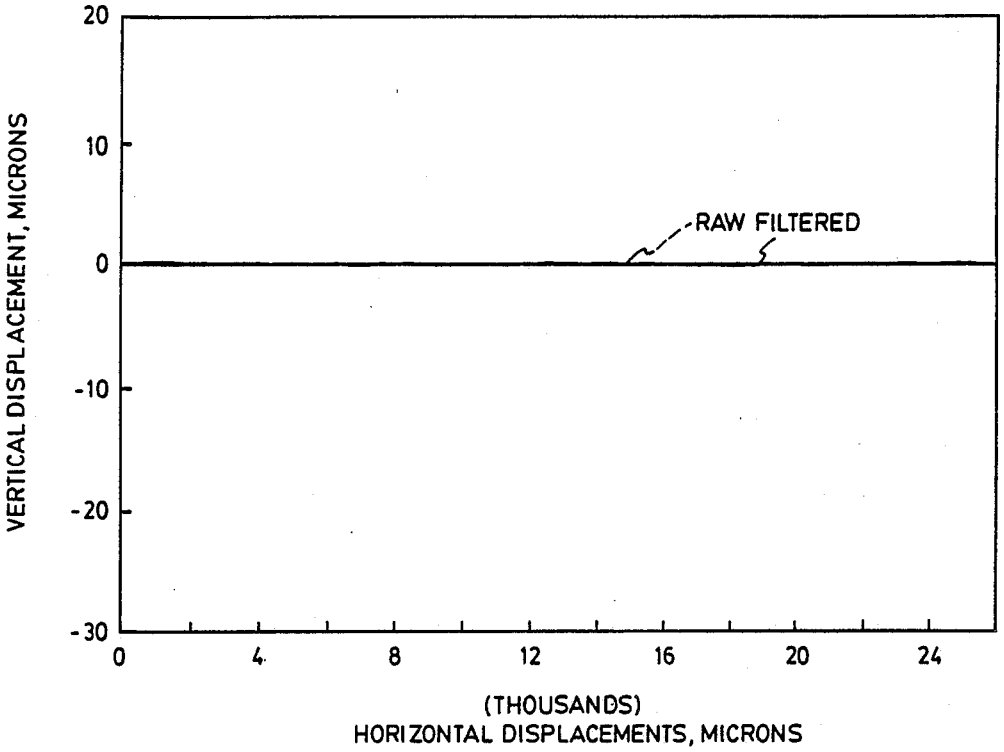
FIG. 4 is a graph (roughness analysis: DuPont-D; Dektak II) showing roughness measurements for a sheet of polyester used in connection with conventional susceptors.

The roughness of the substrate may be understood more fully with reference to FIGS. 4–7. FIG. 4 illustrates the measured roughness for conventional polyester sheet used as a substrate for a typical conventional metallized polyester susceptor. In this example, the polyester sheet was a commercially available polyester sheet sold under the trade name "DuPont-D" by E. I. duPont de Nemours & Company. Conventional metallized polyester susceptor have been made using polyester substrates which are typically as smooth as the example illustrated in FIG. 4.

Figure 5:
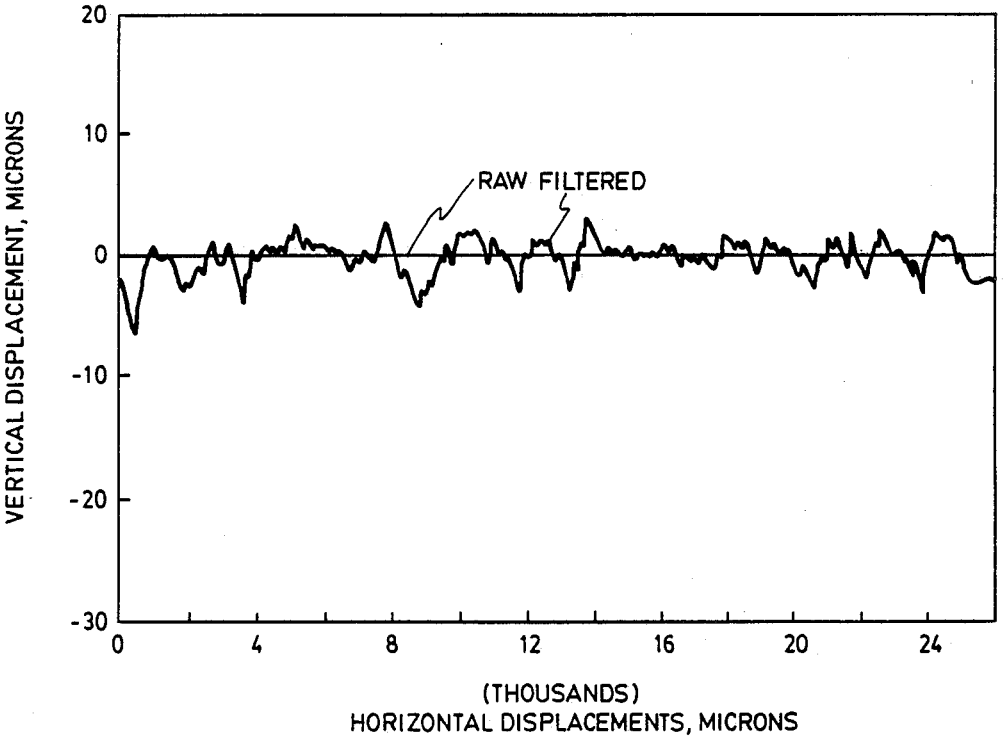
FIG. 5 is a graph (roughness analysis: WAMC16S; Dektak II) depicting roughness measurements for the smooth side of 16 point clay coated SBS paperboard.
Figure 6:
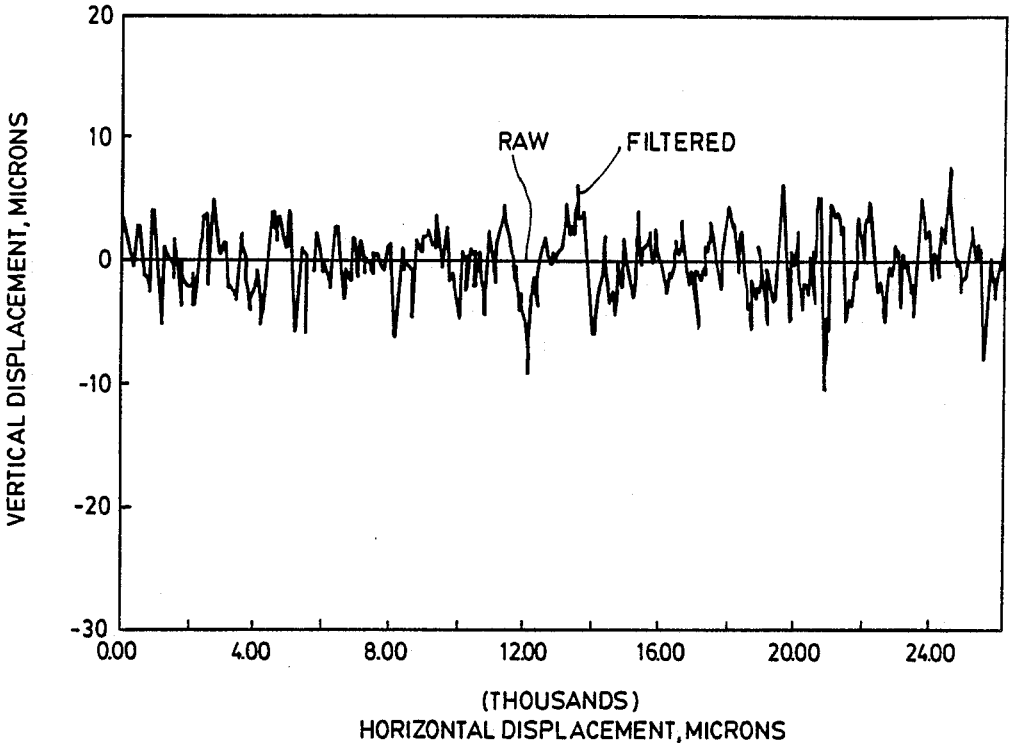
FIG. 6 is a graph (roughness analysis: copier paper; Dektak II) depicting roughness measurements for copier paper.
Figure 7:
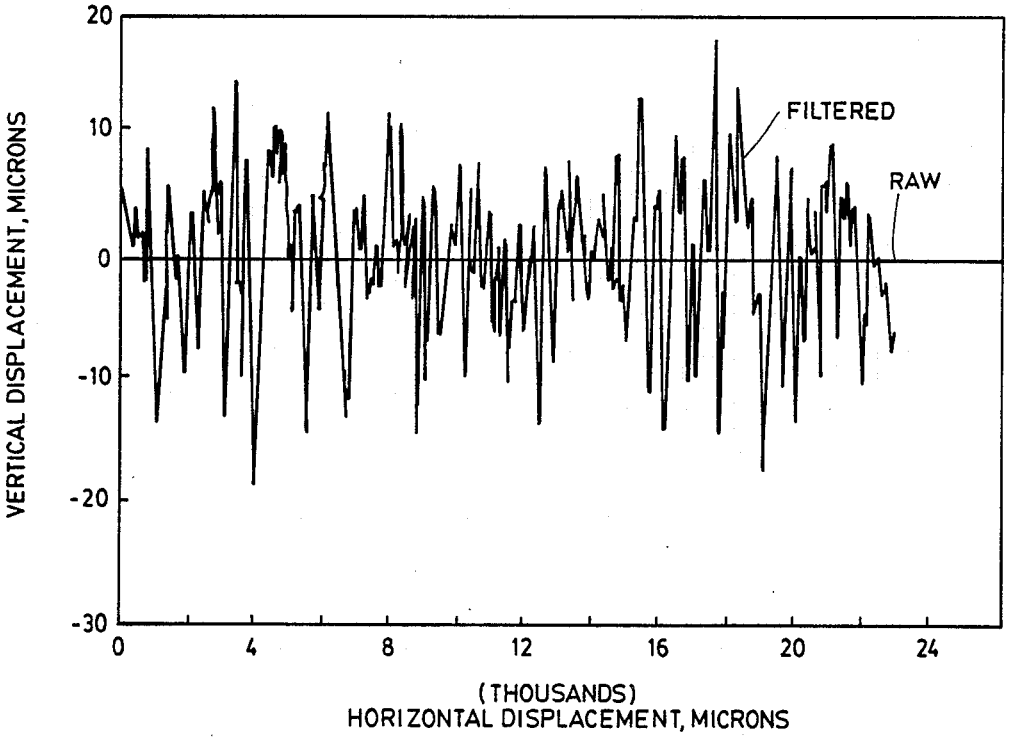
FIG. 7 is a graph (roughness analysis: bond paper; Dektak II) depicting roughness measurements for bond paper.

Surprisingly, the present invention provides useful results utilizing substrates which are relatively rough, such as those shown in FIGS. 5–7. FIG. 5 illustrates the roughness measured for the smooth (or shiny) side of 16 point clay coated SBS paperboard, with a clay wash on the dull side, sold by the Waldorf Corporation of St. Paul, Minn. This is a very smooth shiny-appearing paperboard material. FIG. 6 illustrates the surface roughness measured for copier paper. The copier paper used was Compat DP sub 20, 8½ inch by 11 inch (216 mm by 280 mm), white paper made by Nationwide Papers. FIG. 7 illustrates the surface roughness measured for commercially available bond paper. The bond paper used was Eagle A typing paper, catalog number F420C, Trojan Bond radiant white cockle, 8½ inch by 11 inch (216 mm by 280 mm), 75 g/m$^2$ basis weight paper, made by Fox River Paper Company of Appleton, Wis.

Using the data shown in FIG. 4, an arithmetic average roughness was computed for the Dupont-D polyester film in this example. An arithmetic average roughness of 0.021 microns was computed. The example of clay coated paperboard shown in FIG. 5 provided an arithmetic average roughness of 1.069 microns. The copier paper, see FIG. 6, provided an arithmetic average roughness of 2.074 microns. The bond paper of FIG. 7 provided an arithmetic average roughness of 5.013 microns.

Table II illustrates the arithmetic average roughness computed for several different examples of substrates.

TABLE II

| SUBSTRATE | AA (Microns) |
|---|---|
| FILTER PAPER | 6.497 |
| BOND PAPER | 5.013 |
| 19 PT. MILK CARTON STOCK (DULL SIDE) | 4.823 |
| 24 PT. CLAY COATED SBS (DULL SIDE) | 3.522 |
| 19 PT. MILK CARTON STOCK (SHINY SIDE) | 2.831 |
| ARTIST PAPER | 2.305 |
| COPIER PAPER | 2.074 |
| 16 PT. CLAY COATED SBS (DULL SIDE) | 1.857 |
| POLYESTER SIDE OF OVENABLE PAPERBOARD | 1.333 |
| 16 PT. CLAY COATED SBS (SHINY SIDE) | 1.069 |
| CLAY COATED SIDE OF OVENABLE | 0.894 |
| PAPERBOARD BOPET | 0.891 |
| 24 PT. CLAY COATED SBS (SHINY SIDE) | 0.778 |
| DUPONT-D POLYESTER FILM | 0.021 |

Thus, Substrates having arithmetic average (AA) roughness measurements greater than 0.5 microns may be successfully used in accordance with the present invention.

The susceptor 10 in accordance with the present invention provides a dimensionally stable substrate 11 which maintains its structural integrity during microwave heating. The degree of breakup of the metal film 12 depends on the characteristics of the paper substrate.

Figure 8:
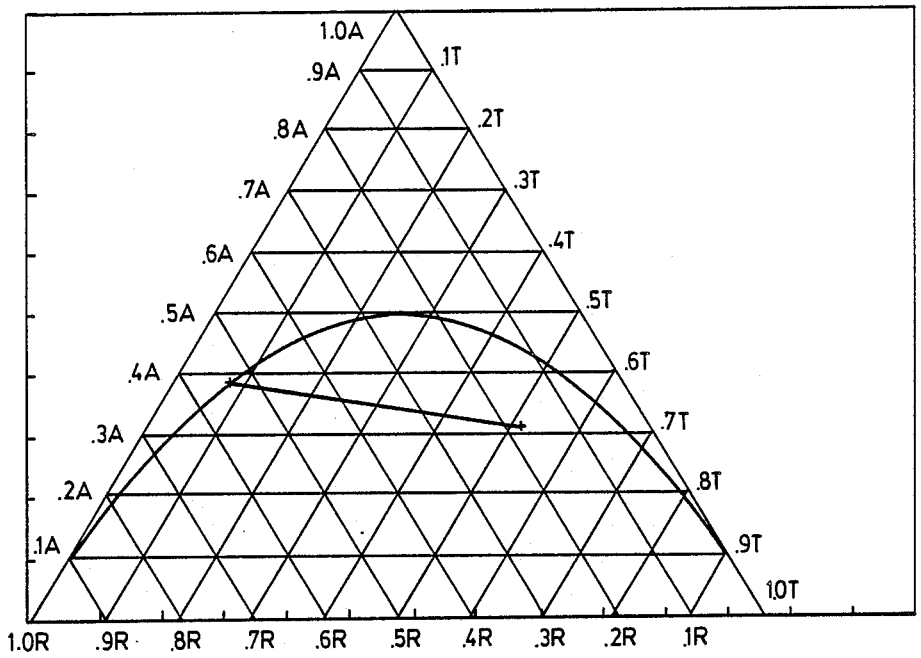
FIG. 8 is a tricoordinate plot depicting measurements before and after microwave heating for a conventional susceptor comprising metallized polyester.

FIG. 8 illustrates the effects of a phenomenon, which is sometimes referred to as "breakup", for a conventional metallized polyester type susceptor. A typical conventional metallized polyester susceptor may be formed from a thin (48 gauge) sheet of biaxially oriented polyester which has a thin film of metal such as aluminum deposited thereon. This metallized polyester sheet is then adhesively bonded to a support sheet of paper or paperboard. When the metallized polyester type susceptor is heated in a microwave oven, the polyester tends to become soft and break up. The reflectance, absorption, and transmission of such a susceptor, as measured with a network analyzer, changes dramatically after microwave heating. This is illustrated in the tricoordinate graph of FIG. 8, which illustrates data for a conventional metallized polyester type susceptor. Biaxially oriented polyester on paperboard, which had been metallized with aluminum, was used for the experiment of FIG. 8. The data point on the left represents measurements taken prior to microwave heating. The data point on the right represents data points taken after microwave heating. Arrows are drawn between the "before heating" data points and the "after heating" data points, to show the change which occurred.

Figure 9:
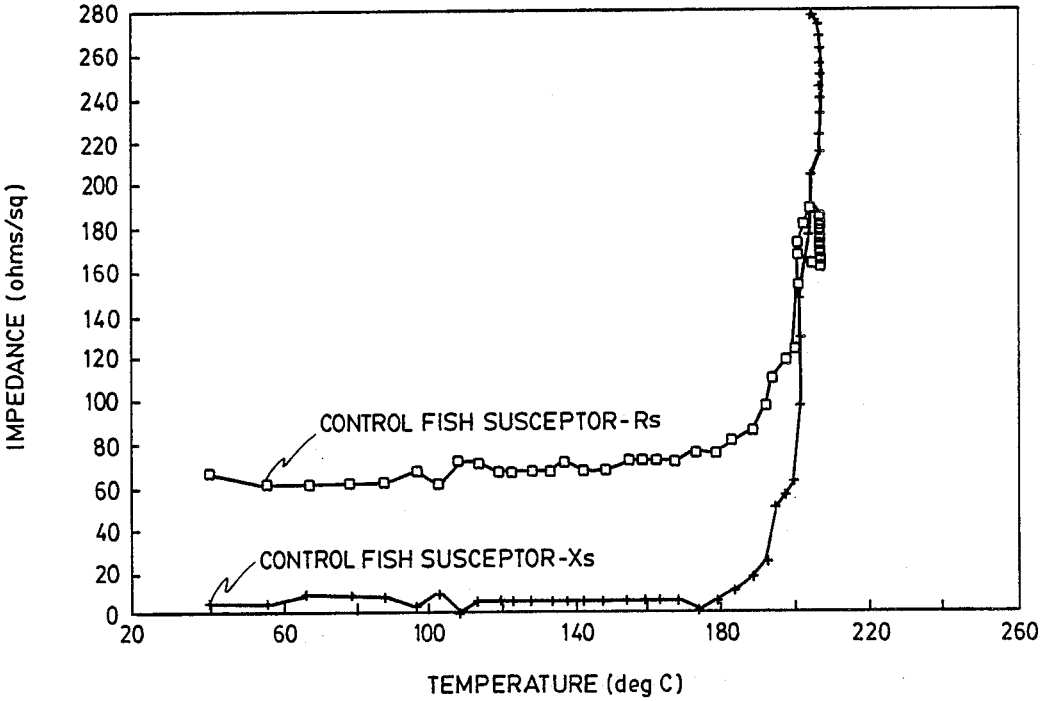
FIG. 9 is a graph depicting impedance measurements versus temperature for a conventional susceptor during exposure to microwave radiation.

FIG. 9 illustrates impedance measurements taken for a conventional metallized polyester type susceptor. Measurements were taken in one second intervals. During each one second interval, the complex impedance of the susceptor was measured, and a point representing the imaginary or reactive component of the impedance was plotted as "Xs", and a point corresponding to the real or resistive component of the impedance was plotted as "Rs". FIG. 9 shows that after a certain period of time, when the susceptor exceeded 180° C., the impedance of the susceptor began to change significantly. The reactive component "Xs" began to increase dramatically. The resistive component "Rs" also increased, reached a maximum of about 190 ohms/square, and then began to decrease to a value less than 160 ohms/square. These changes in a conventional susceptor typically result in a reduced responsiveness to the heating effects of microwave radiation. The measurement technique used to produce the data plotted in FIG. 9 is hereafter described in more detail; however, it should be noted that the susceptor temperature effect plotted on the horizontal axis was achieved as a result of heating due to microwave radiation.

In some applications, it may be desirable to use a susceptor which is more electrically stable during heating. Here, stability refers to the ability of the susceptor to maintain its electrical characteristics, i.e., complex impedance, reflection, absorption and transmission, during microwave heating. The present invention may be utilized to produce a susceptor which does not deteriorate as extensively during microwave heating as a conventional susceptor. In the example shown in FIG. 10, an example of aluminum deposited directly on paper was measured. The measurements of absorption, reflection and transmission, measured prior to microwave heating, are shown on the left. The data point measured after microwave heating is shown slightly to the right. Comparison of the "before heating" data point with the "after heating" data point shows that the measurements barely changed. In this example, the susceptor was much more stable. This is an example of what can be done with a susceptor constructed in accordance with the present invention, if stability is desired. In applications where stability of susceptor performance is a desirable design consideration, this example, see FIG. 10, would perform significantly better than the prior art metallized polyester type susceptor, see FIG. 8.

Figure 10:
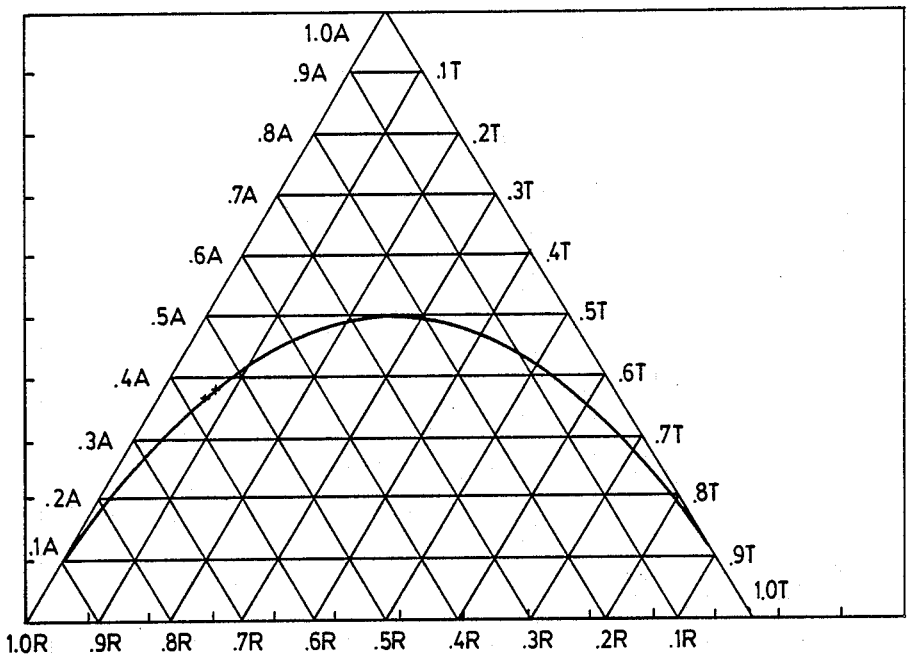
FIG. 10 is a tricoordinate plot depicting measurements before and after microwave heating of a susceptor made in accordance with the present invention.
Figure 11:
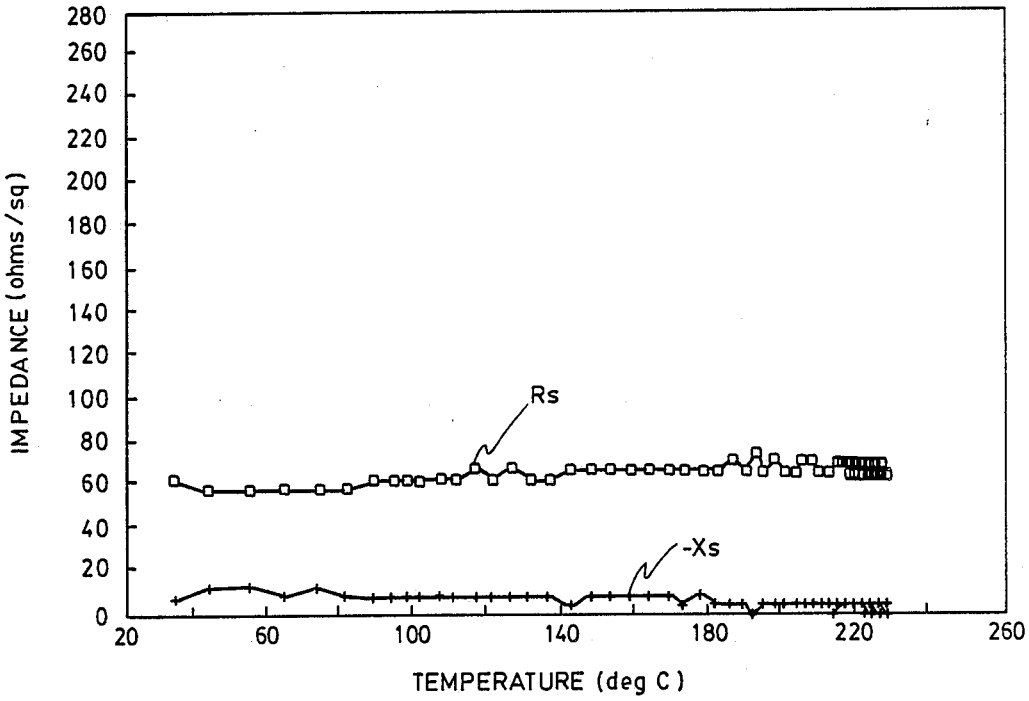
FIG. 11 is a graph depicting impedance measurements versus temperature taken for the susceptor used in connection with FIG. 10.

FIG. 11 illustrates data measurements taken with the susceptor used for the data shown in FIG. 10. The impedance and temperature were measured for one second intervals during microwave heating. For each impedance measurement, a data point was plotted corresponding to the resistive component "Rs" of the impedance, and a data point was plotted corresponding to the reactive component "Xs" of the impedance. The impedance of the susceptor constructed in accordance with the present invention was relatively stable, as shown in FIG. 11. Of particular note is the low value of the reactive component "Xs", which remained low during heating.

In this example, the susceptor did not continue heating beyond 230° C. Because the susceptor in this example had a relatively low impedance, the susceptor did not continue to increase in temperature because a steady state condition was achieved where the rate of power absorbed by the susceptor was equal to the rate of power dissipated to the environment. Because the susceptor is so stable, if more power had been applied, or if the susceptor had a higher resistive component "Rs" for the impedance, the temperature would have continued to increase until a new steady state condition was reached. It is possible, in accordance with the present invention, to make a susceptor which is stable, and which continues to absorb microwave radiation at a constant rate during exposure to microwave radiation. Higher temperatures can be reached than those previously reached by typical conventional susceptors.

Figure 12:
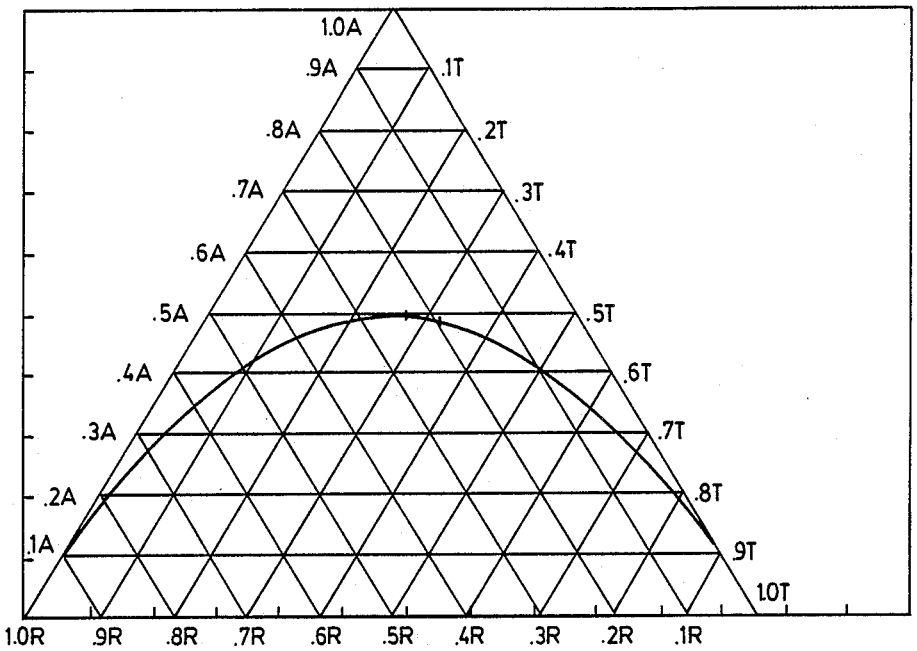
FIG. 12 is a tricoordinate plot depicting measurements before and after microwave heating for a susceptor made in accordance with the present invention.

FIG. 12 is a tricoordinate graph illustrating measurements of reflection, absorption and transmission of another stable susceptor constructed in accordance with the present invention. The data point on the left represents measurements taken prior to microwave heating. The data point on the right represents measurements taken after microwave heating. Comparing the "before heating" data point and the "after heating" data point, the changes which occurred as a result of microwave heating are not significant. In this example, the susceptor was constructed from a thin film of stainless steel deposited on 16 point clay coated, natural kraft paperboard, sold by Mead Paperboard Products, a division of Mead Corporation, under the catalog designation Carton Kote H-12; (the paperboard was obtained from a Livingston, Ala. facility). The thickness of the stainless steel coating was 1895 Angstroms.

Figure 13:
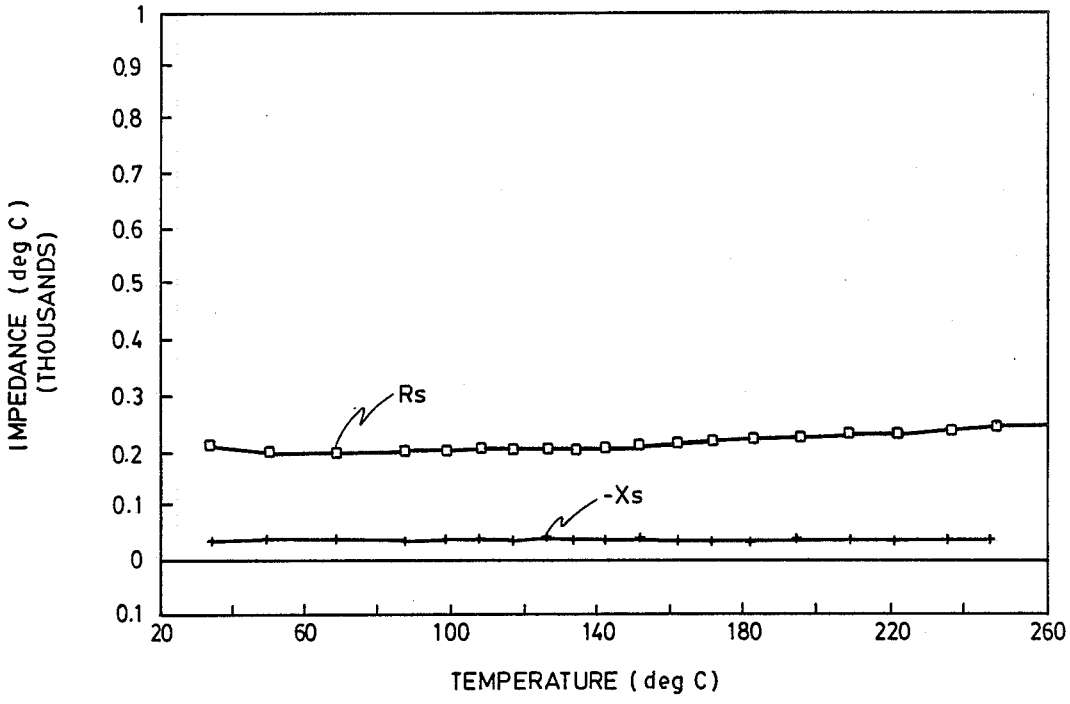
FIG. 13 is a graph depicting impedance measurements versus temperature during microwave heating of the susceptor used in connection with FIG. 12.
Figure 16:
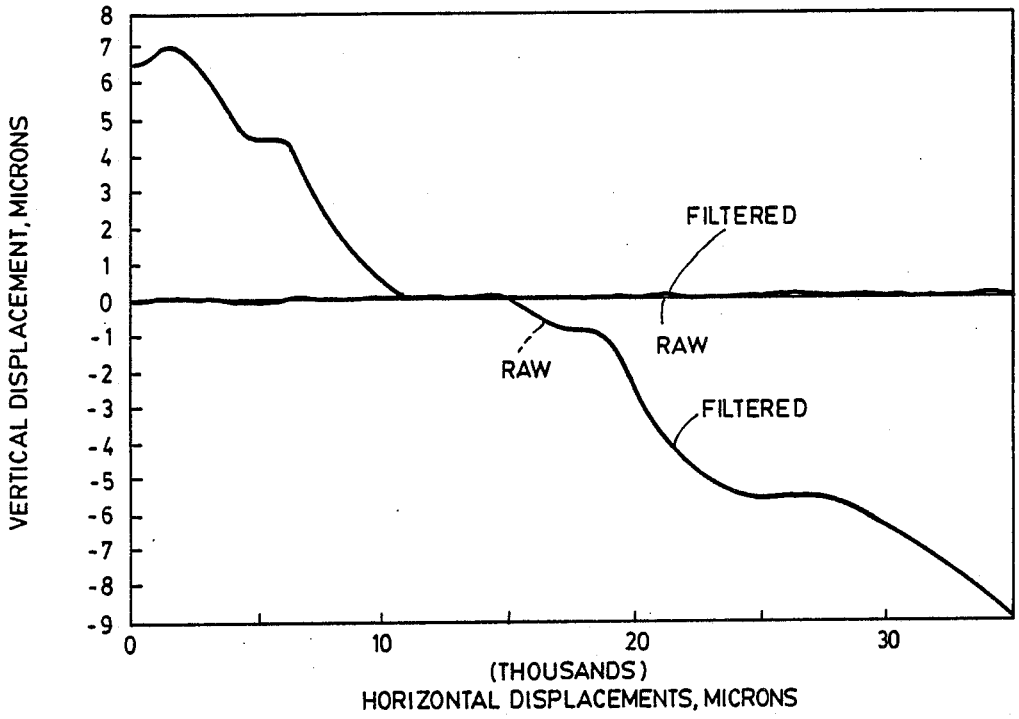
FIG. 16 is a graph (roughness analysis: DuPont-D; Dektak II) depicting the raw data roughness measurements used to produce the graph of FIG. 4.
Figure 17:
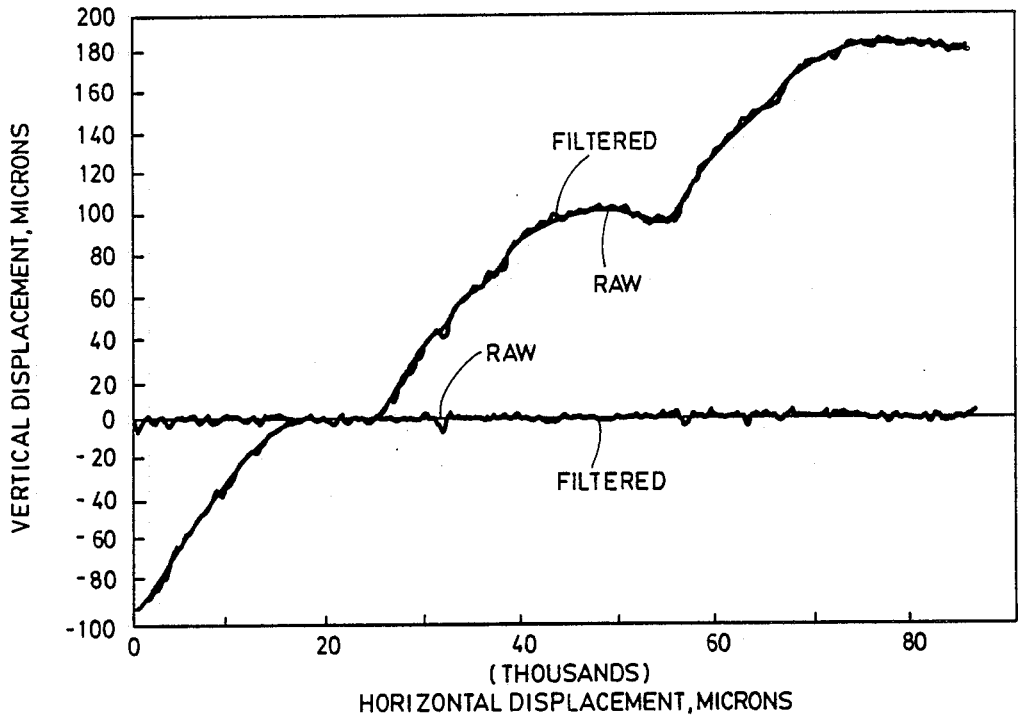
FIG. 17 is a graph (roughness analysis: WAMC16S; Dektak II) depicting the raw data roughness measurements used to produce the graph of FIG. 5.
Figure 18:
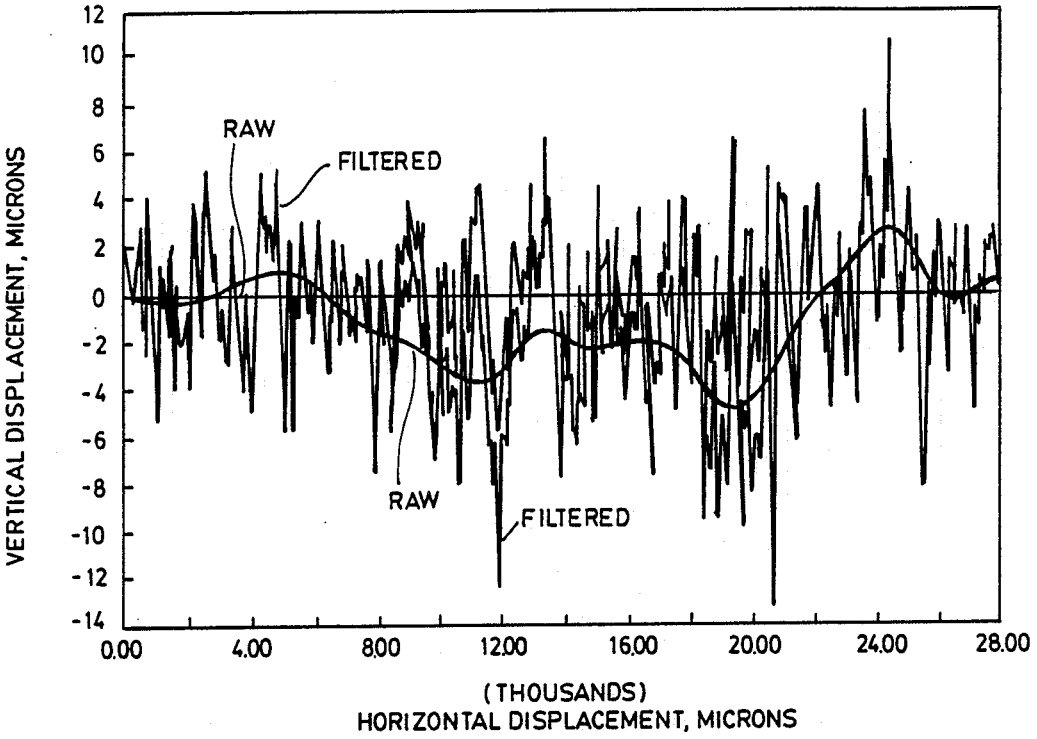
FIG. 18 is a graph (roughness analysis: copier paper; Dektrak II) depicting the raw data roughness measurements used to produce the graph of FIG. 6.
Figure 19:
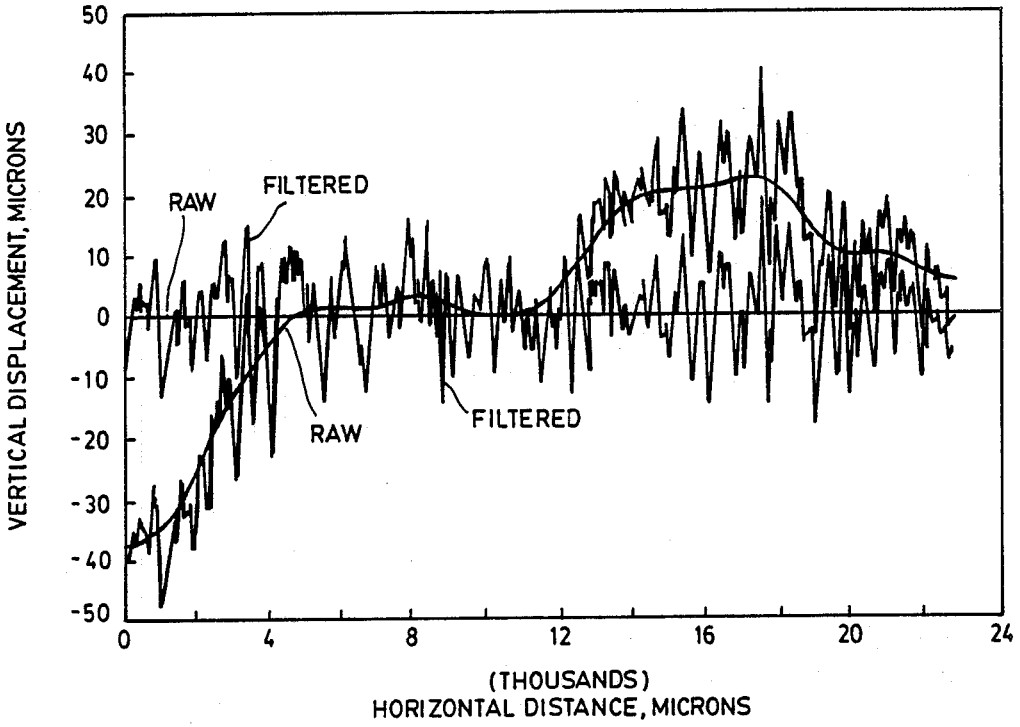
FIG. 19 is a graph (roughness analysis: bond paper; Dektrak II) depicting the raw data roughness measurements used to produce the graph of FIG. 7.

FIG. 13 represents measurements of impedance and temperature taken at half second intervals during microwave heating of the susceptor used to plot the data points shown in FIG. 12. During each half second interval, the impedance was measured, and a data point representing the reactive component "Xs" was plotted, and a data point representing the resistive component "Rs" was plotted. It can be seen from FIG. 13 that the impedance of the susceptor remained relatively stable during microwave heating. Also apparent, is the fact that the susceptor is capable of continuing to heat beyond the maximum temperature which can be attained using a conventional metallized polyester type susceptor. The susceptor temperature exceeded 260° C. before power was shut down. In some applications, this heating performance may be a desirable characteristic.

FIG. 14 is a graph illustrating measurements of absorption, reflection and transmission (versus temperature) for an example of a susceptor constructed in accordance with the present invention which heated rapidly when exposed to microwave radiation. This example also had stable electrical characteristics. Each data point represents a measurement taken at one second intervals. This susceptor reached 260° C. in only 4 seconds. The susceptor's electrical characteristics also remained stable. In this example, a thin film of stainless steel was deposited on a 40 pound basis weight bleached natural kraft machine glazed foil mounting paper. This paper was manufactured by the Thilmany Pulp & Paper Company, P.O. Box 600, Kaukauna, Wis. 54130, and sold under the catalog number of 84600 M.G. foil mounting paper. The thin film stainless steel coating was measured as having a thickness of 2005 Angstroms. Measurement of the impedance of the susceptor resulted in a measurement of about 730 ohms/square resistive component, and about −120 ohms/square reactive component.

A susceptor constructed in accordance with this example may be useful in connection with an embodiment of the invention employing a susceptor having disruptions in the continuity of the metallized film. The susceptor heats very quickly and remains electrically stable. This is discussed more fully below.

Because of the enhanced stability achieved by the present invention, the power absorbed and thus the heating achieved may, in some cases, exceed that required by the product. The susceptor surface may be modified as taught in application Ser. No. 197,634 (incorporated herein by reference) and illustrated in FIG. 15, in order to achieve the desired heating result.

Cuts or other disruptions 18 to the continuity of the thin metal film 19 are introduced in the surface of the susceptor 20. This "detunes" the susceptor 20. The impedance can be set to a desired level prior to heating by introducing disruptions 18 to the continuity of the metal film 19. Due to the stability introduced by the present invention, the susceptor 20 will tend to maintain its electrical characteristics and impedance during heating.

For example, in FIG. 15, the overall impedance has been increased, and therefore heating decreased, by introducing electrical discontinuity 18 in the thin film surface 19. Furthermore, the perimeter 21 has been "detuned" more than the center 22 to control edge overheating.

Figure 3:
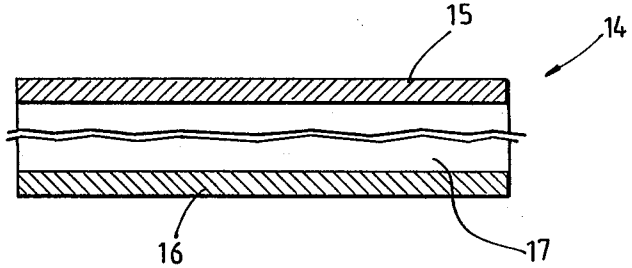
FIG. 3 is a cross-sectional side view of an alternative embodiment of a susceptor having a metallized layer on two sides of the substrate.

FIG. 3 illustrates an alternative embodiment of a susceptor 14. A first thin film of metal 15 and a second thin film of metal 16 are provided on two sides of a paper substrate 17. In other words, opposite sides of the paper substrate 17 are both coated with a thin film of metal 15 and 16. The thickness of the metal films 15 and 16 are greatly exaggerated for purposes of illustration in FIG. 3. Coating two sides of the paper substrate 17 provides increased power absorption and resultant heating without arcing. This enhances performance for heating foods.

Coating two sides of a paper substrate 17 provides the ability to achieve a lower net effective impedance for the susceptor 14 without arcing. Such a structure is more stable, both physically and electrically.

In one example, a sheet of clay coated solid bleached sulfate paperboard from Waldorf Corporation, 16 point paper, was coated on both sides with a thin metal film of aluminum. The thickness of the thin metal film on each side was 200 Angstroms. For purposes of comparison, an identical sheet of paper was coated on the same side with a thin film of aluminum that was 400 Angstroms thick. The impedance of both susceptors was measured. The first two-sided susceptor, when measured with a network analyzer, yielded an impedance measured as 16.5–j 1.8 ohms/square. The susceptor example which was coated on one side only yielded an impedance measurement of 23.5–j 1.4 ohms/square.

Both susceptors were placed into a microwave oven and exposed to microwave radiation for 4 seconds. No arcing was observed on the two-sided susceptor. The susceptor which was coated on one side exhibited severe arcing during the same period of time. After exposure to microwave radiation, the impedances of the two susceptors were again measured. The two-sided susceptor yielded an impedance measurement of 24.2–j 7.4 ohms/square. The susceptor coated on one side only yielded an impedance measurement of 39.1–j 103.6 ohms/square. The two-sided susceptor appeared to be electrically stable. The impedance did not change significantly as a result of exposure to microwave radiation. However, the susceptor coated on one side only exhibited a significant change in impedance after exposure to microwave radiation.

In this example, the reflection ("R"), transmission ("T") and absorption ("A") for each susceptor was measured using a network analyzer, both before exposure to microwave radiation and after exposure. In the example of the susceptor which was coated on two sides, the values measured prior to exposure to microwave radiation were: R=0.845; T=0.007; and, A=0.148. The values measured after exposure to microwave radiation were: R=0.784; T=0.014; and, A=0.202. For the example of the susceptor which was coated on one side only, the values measured prior to exposure to microwave radiation were: R=0.790; T=0.012; and, A=0.197. For the susceptor which was coated on one side only, the values measured after exposure to microwave radiation were: R=0.568; T=0.196; and, A=0.236.

In the example of the susceptor coated on two sides, there was minimal change in reactance after exposure to microwave radiation. The example of the susceptor which was coated on one side only exhibited a significant change in reactance after exposure to microwave radiation. This suggests that the electrical continuity of the thin metal film which was coated on only one side of the susceptor was disrupted during exposure to microwave radiation. Conversely, this suggests that little disruption occurred in the example of the susceptor which was coated on two sides. Thus, two-sided susceptors may be more stable than a one-sided susceptor of the same thickness.

Two-sided susceptors provide the ability to operate at low impedances which were not possible previously. In addition, two-sided susceptors provide very stable performance when exposed to microwave radiation.

In some applications, it may be desirable to place the non-metallized side of the susceptor in contact with the food product. In this example, 1005 Angstroms of stainless steel was deposited on artist paper. Initially, the surface impedance was 317–j 7 ohms/square. This susceptor was placed metal-side-down under a Totino's Microwave Pizza, replacing the conventional in-package susceptor. The pizza was microwaved for 2 minutes on high. In this case, the susceptor was effective to dramatically heat the pizza crust. This example demonstrated that cooking metal-side-down is capable of producing more than sufficient heat to crisp food. In this example, the heating was not adjusted to produce a desirable overall cooking of the pizza.

In the past, while it has been recognized as desirable to tailor a particular susceptor design to the food product which is intended to be heated in a microwave oven, in fact one did not have the ability to effectively adjust the susceptor. First, design and process constraints on conventional susceptors limited the ability to adjust a susceptor. The range of impedance which could be achieved with conventional susceptor processes, and the constraints due to the occurrence of arcing in conventional susceptors, greatly limited the adjustment which would be possible. In addition, due to the "breakup" of conventional susceptors during microwave heating, the characteristics of the susceptor would change so quickly during microwave heating that adjustment efforts were essentially futile.

The present invention addresses this problem effectively. The present invention provides the ability to adjust the performance characteristics of a susceptor within a wide range. The thickness of the metal coating, the composition of the metal, the roughness of the paper substrates, coatings applied to the substrate, etc., provide a wide range of possible susceptor characteristics which may be used-to adjust the susceptor to match the food product. More significantly, the stability achieved by the present invention renders such efforts worthwhile, because the susceptor performance characteristics can be made to remain relatively stable and thereby remain in matching relationship to the food product. It has been observed experimentally that clay coated paper substrates generally tend to be more stable when used to heat many food products, than paper substrates which are not clay coated. It has also been observed that stainless steel susceptors are often more stable than aluminum susceptors.

Figure 20:
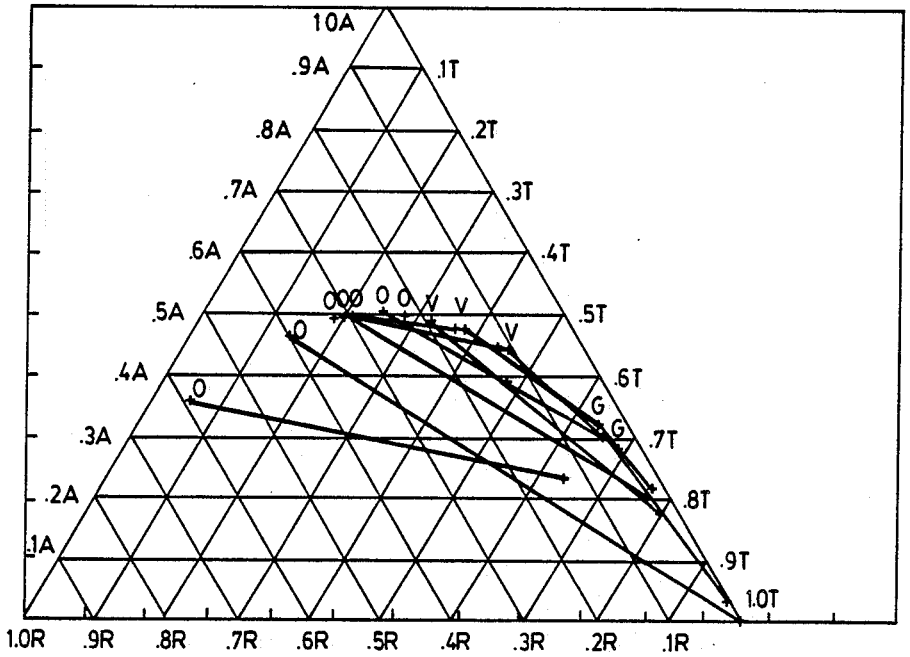
FIG. 20 is a tricoordinate plot (DSI SS susceptors, fish) depicting measurements before and after microwave heating of susceptors used to heat a fish food product.

In matching the performance characteristics of a susceptor to a particular food product, it may be desirable to experimentally plot various susceptor designs on a tricoordinate plot, as shown in FIG. 20. FIG. 20 illustrates various susceptor designs, all made in accordance with the present invention, which were used to heat Van de Kamp's Microwave Fillets (fish) in a microwave oven. All of the susceptors used in this example employed a thin film of stainless steel deposited on various types of paper substrates. The results of microwave heating are indicated in each example as follows: "O"=overheated; "V"=very good results; "G"=good heating results. The various susceptors which are plotted in the graph of FIG. 20 all changed in performance characteristics during microwave heating. Swelling of the paper as a result of moisture absorption was believed to contribute to the performance change in the susceptors. The graph of FIG. 20 reflects tests using different types of paper substrates. The graph does not reveal the actual path the performance change followed nor the length of time the susceptor remained at any given performance condition (i.e., place on the graph) during microwave heating. Thus, two different susceptors which had identical starting points and identical ending points could give different cooking results if one susceptor very quickly moved to its end point during microwave heating, while the other remained at its starting point, and did not move to its end point until late during the heating cycle. Coatings for the paper, such as clay coatings, may reduce the amount of moisture absorbed by the susceptor and thereby improve stability during microwave heating.

It may be desirable to coat a substrate having a rough surface with a thin metal film to achieve a predetermined surface resistance. Surface resistance is defined by the following equation:

$$Rs=1/(st)$$

where "Rs" is the surface resistance in ohms/square, "s" is the electrical conductivity of the bulk metal, in reciprocal (ohm-cm), and t is the film thickness in centimeters. For metal films whose thickness is less than several times the electron mean free path, the film conductivity will be less than the bulk conductivity. Equations to convert bulk metal conductivities to film conductivities are given by Hansen and Pawlewicz, IEEE Microwave Theory and Techniques, Vol. 30, p. 2064–66 (1982), which is incorporated herein by reference. The mean free path correction leads to the following equation:

$$Rs=1/s_f t$$

where "$s_f$" is the film conductivity.

At very low levels of metal deposition, the metal is believed to deposit in discrete regions, areas or "globs" which grow and coalesce as more metal is deposited. Thus, the film begins as discrete, electrically unconnected regions and becomes electrically more connected as the metal thickness increases. The equation given above, while properly correcting for electron mean free path effects in thin films, assumes that even the thinnest films are continuous, while the experimental evidence indicates that they are discontinuous.

Coating a rough surface to a predetermined desired surface resistance requires the deposition of more metal than would be required to achieve the same resistance on a smooth substrate. Several factors contribute to this phenomenon: rough substrates have more actual surface area per square centimeter of material, the coating uniformity at the micron and sub-micron level may be less uniform due to local shadowing (e.g., by a protruding paper fiber), and surface roughness makes achieving any particular degree of film electrical connectedness more difficult. In addition, the first metal to arrive at the substrate may be subject to chemical reaction with compounds absorbed on the surface. Treating the first few tens of Angstroms of metal as if they had no contribution to an electrically effective thickness leads to the following equation:

$$Rs = C/s_f(t - to)$$

where "C" is a constant for a particular metal and substrate, "$s_f$" is the film conductivity, corrected for mean free path effects, "(t−to)" is conceptually the effective thickness, and "to" is conceptually the thickness of metal which must be deposited on a particular substrate before the deposition of more metal has an observable electrical effect at a particular microwave frequency. Experimental Rs versus metal thickness data for several substrates was fitted to the above equation using the SAS NLIN software procedure, available from SAS, Inc., Cary, N.C. The fit was weighted by one minus the susceptor transmission coefficient since this approximates the accuracy of the Rs measurement. For aluminum, C and to are functions of surface roughness as measured by the AA method. The data are shown in Table III.

TABLE III

| SUBSTRATE | SURFACE ROUGHNESS AA, Microns | C | to Angstroms |
|---|---|---|---|
| Bond | 5.0126 | 46.65 | 130.3 |
| Biax-PET | 0.8909 | 7.81 | 68.5 |
| Copier | 2.0740 | 58.38 | 76.0 |
| Dupont-D | 0.0206 | 1.64 | 64.6 |
| Filter | 6.4971 | 104.53 | 149.9 |
| WAMC16D | 1.8673 | 29.10 | 84.27 |
| WAMC16S | 1.0686 | 19.14 | 94.11 |
| Westvaco board | 0.8940 | 21.63 | 95.0 |
| Westvaco PET | 1.3334 | 2.15 | 73.0 |

Curves fitted using least-squares fits through the data in Table III gives the following equations:

$$C = 13.7(AA) + 2.46$$

$$to = 12.6(AA) + 65.4$$

The r squared value for the equation for "C" is 0.78, and for the equation for "to" is 0.85.

These equations may be used to estimate the thickness "t" of aluminum required to achieve a desired predetermined surface resistance "Rs" for a substrate with a roughness of AA microns. The roughness AA is measured. The conductivity for the specific metal is corrected for mean free path effects to determine sf. The roughness AA is plugged into the above equations to calculate C and to. Then t may be calculated using the equation described above.

This procedure can reduce the time required to empirically determine the optimum metal thickness for a given substrate material.

All examples of paper coated with thin films of metal herein described were produced in a laboratory vacuum coater unless otherwise noted. The vacuum chamber used measured 30" (76.2 cm)×30" (76.2 cm) and was equipped with both electron guns and resistive boats as sources for evaporation. Planetary rotating racks were used for holding the substrate and insuring coating uniformity. Water cooled copper crucibles were used for electron gun evaporation. The chamber was not heated. A crystal monitor, described above, was used for measurement of the thickness of deposited coating.

In operation, the crucibles were charged with aluminum or stainless steel 316. The samples to be coated were attached onto the rotating racks. The chamber was pumped down to, typically, $10^{-5}$ to $10^{-6}$ torr. The deposition then proceeded, using a crystal monitor to measure the coating thickness progress.

Susceptor surface impedance, surface resistance, absorption (or absorbance), reflection (or reflectance), and transmission (or transmittance) measurements were made at the microwave oven operating frequency of 2.45 GHz and at room temperature (20–25° C.) unless otherwise specified. References to absorption or absorbance mean power absorption. References to reflection or reflectance mean power reflection. References to transmission or transmittance mean power transmission. A network analyzer is used to make such measurements.

In the above descriptions, measurements taken with a network analyzer all involved the procedure described below. A Hewlett Packard Model 8753A network analyzer in combination with a Hewlett Packard 85046A S-parameter test set is connected to either WR-340 or WR-284 waveguide and calibrated according to procedures published by Hewlett Packard. Measurements are made without the presence of a food item, unless otherwise specified.

Measurements are preferably made by placing a sample to be measured between two adjoining pieces of waveguide. Conductive silver paint may be placed around the outer edges of the sample sheet which is cut slightly larger than the cross-sectional opening of the waveguide. Colloidal silver paint made by Ted Pella, Inc. has given satisfactory results in practice. The sample is preferably cut so that it overlaps the waveguide perimeter by about 0.127 cm around the edge.

Scattering parameters $S_{11}$ and $S_{21}$ are measured directly by the network analyzer, and are used to calculate power absorption (or absorbance), reflection (or reflectance), transmission (or transmittance), and surface impedance. From port 1 of the network analyzer, the power $S_{11}$ squared and the power transmission is the magnitude of $S_{21}$ squared. The power absorption in the waveguide is then equal to one minus the sum of the power reflection in the guide and the power transmission in the guide. The susceptor absorption, transmission, and reflection values reported herein are corrected to free-space values using the impedance of free space, the impedance of the waveguide in which the measurements are made, and the equations presented by J. Altman, *Microwave Circuits*, pp. 370–371 (1964). The complex surface impedance of the susceptor is calculated using equations presented in R. L. Ramey and T. S. Lewis, "Properties of Thin Metal Films at Microwave Frequencies", *Journal of Applied Physics*, Vol. 39, No. 1, pp. 3383–3384 (1968), substituting Zs, the complex surface impedance for $1/\sigma$ d, where $\sigma$ is the conductivity of the metal film and d is its thickness. The above Altman and Ramey & Lewis references are incorporated herein by reference.

Substrate surface roughness is measured using the stylus method more fully described in the Handbook of Thin Film Technology, pages 6–33 to 6–39 (ed. L. I. Maissel & R. Glang 1970) [1983 Reissue], which is incorporated herein by reference. The deflection of a Dektak Model II profilometer with a stylus tip diameter of 12.5 microns was recorded as the stylus was drawn across a substrate surface. Individual scan lengths of about 30 millimeters were used, several of which were concatenated together. Digital data was provided by the Dektak and output in a computer.

To prepare a free film for surface roughness analysis on the Dektak II profilometer, the film should be taped to an optically polished flat surface and gently stretched to flatten the film against the flat support. This is done to avoid erroneously high roughness readings generated by buckling of the film as the stylus is drawn across the film. In addition, the flat support and the film should be rigorously free of dust before measurement with the profilometer. Where the film is transparent, proper stretching can be verified since stretching will result in the appearance of a few interference fringes generated by the air gap between the film and support.

The raw data produces a plot which includes roughness, waviness and flatness. Surface profile plots for several substrates are shown in FIGS. 16 to 19. It is desirable to eliminate the waviness and flatness information. The waviness and flatness information contained in the plots of FIGS. 16–19 was eliminated to produce the corresponding plots of FIGS. 4–7, respectively. This was conveniently done using computer software such as that used for processing electrical signals to simulate the effect of a filter. In the examples illustrated in FIGS. 16–19, which were used to produce FIGS. 4–7, a low pass filter having a cutoff frequency of 0.03 was simulated using Asyst 2.01 software, commercially available from Macmillian Software Company. The output of the low pass filter was then subtracted from the raw data plotted in FIGS. 16–19, thereby leaving only the roughness information shown in FIGS. 4–7. The effect of this was to exclude waviness components having a period on the horizontal axis greater than 1.5 millimeters. In other words, only the high frequency components (i.e., the roughness data) were left after this processing.

With this data, the arithmetic average (AA) roughness can be calculated as described in the Handbook of Thin Film Technology. The data, now having only the roughness information, is analyzed using Asyst 2.01 software, by placing an array containing the roughness information on the computer's stack. A statistical mean is calculated. The mean is subtracted from a duplicate of the original data to produce a set of data with a zero offset. In analogy to electrical signal processing, this step was equivalent to eliminating any remaining direct current components.

The arithmetic average (AA) roughness value was calculated by taking the absolute value of the resulting array of data points, and subsequently computing the average. Using Asyst 2.01 software, this was done using the Asyst commands "ABS" and "MEAN".

The computer-program used in the above-described examples is listed in Table IV.

TABLE IV

Import data from a Lotus file, starting in cell B4, and extending down N cells. Then apply a filter whose frequency is set by SET.CUTOFF.FREQ. Subtract the filtered data from the raw data to leave the (desired) high frequency data on the stack. Plot it and send it to Lotus. Calculate the AA, the roughness average, and send it to Lotus.

```
DP.REAL DIM[ 5000 ] ARRAY YY        array to contain raw data
REAL SCALAR N                       length of actual data set
REAL SCALAR AA                      AA value
70 STRING FIL                       name of file string
.03 SET.CUTOFF.FREQ                 filter, units of cycles/point
RAD                                 set to radians
: GO
NORMAL.DISPLAY O YY :=                          clears yy array
CR ." SOURCE FILE: "                            target LOTUS file with raw data
"INPUT "DUP FIL ":= DEFER> 123FILE.OPEN         Opens target LOTUS file.
CR ." INPUT # OF POINTS: " #INPUT N :=
2 4 N 1 123READ.RANGE YY SUB[ 1 , N ] 123FILE>ARRAY     LOTUS file→ASYST
YY SUB[ 1 , N ] 15 COLOR Y.AUTO.PLOT                    Plot raw data,
YY SUB[ 1 , N ] DUP SMOOTH DUP 12 COLOR Y.DATA.PLOT     filter, plot, and send
DUP 2 6 123WRITE.DOWN ARRAY>123FILE                     filtered data→LOTUS.
- DUP 9 COLOR Y.DATA.PLOT                       Subtract filter from raw data,
DUP 2 7 123WRITE.DOWN ARRAY>123FILE             plot it and send to LOTUS.
DUP DUP MEAN - ABS MEAN AA :=                   Calculate the AA value.
AA 4 1 123WRITE.DOWN ARRAY>123FILE              Send the AA value→LOTUS.
123FILE.CLOSE                                   Type the AA value on the
-1 4 FIX.FORMAT CR ." AA = " AA . ;             monitor to 4 decimal places.
```

Figure 21:
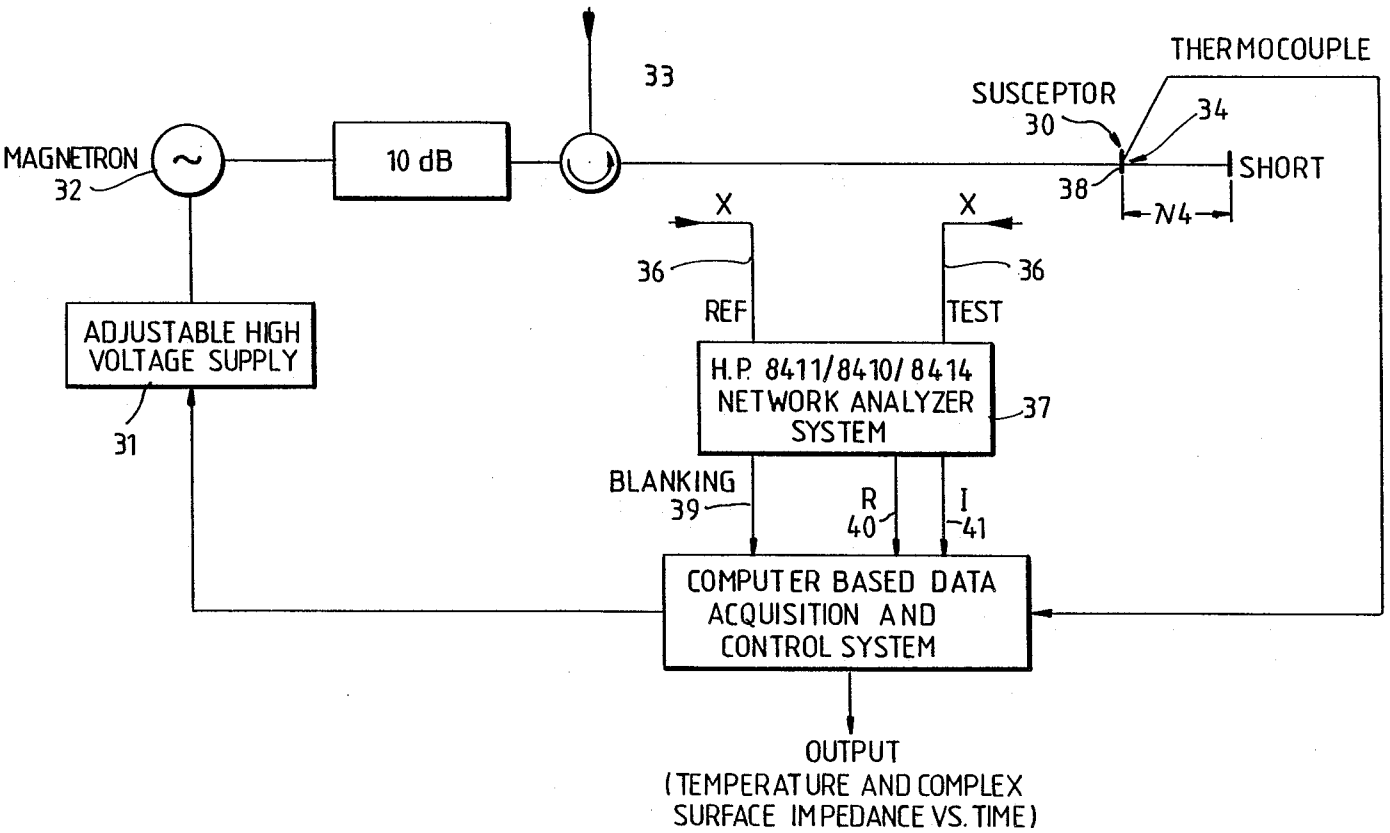
FIG. 21 is a schematic block diagram illustrating a test apparatus used to generate the data shown in FIGS. 9, 11, 13 and 14.
Figure 4:
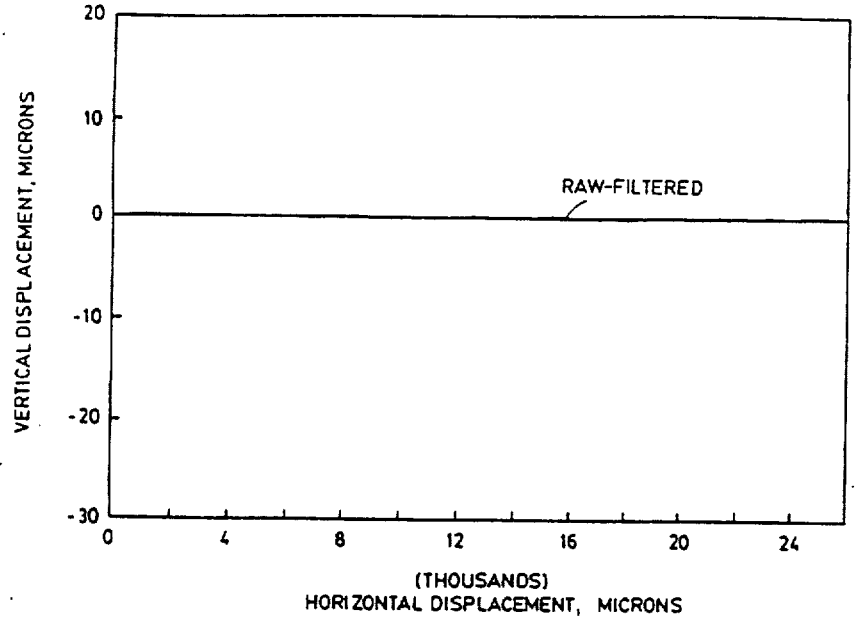
Figure 5:
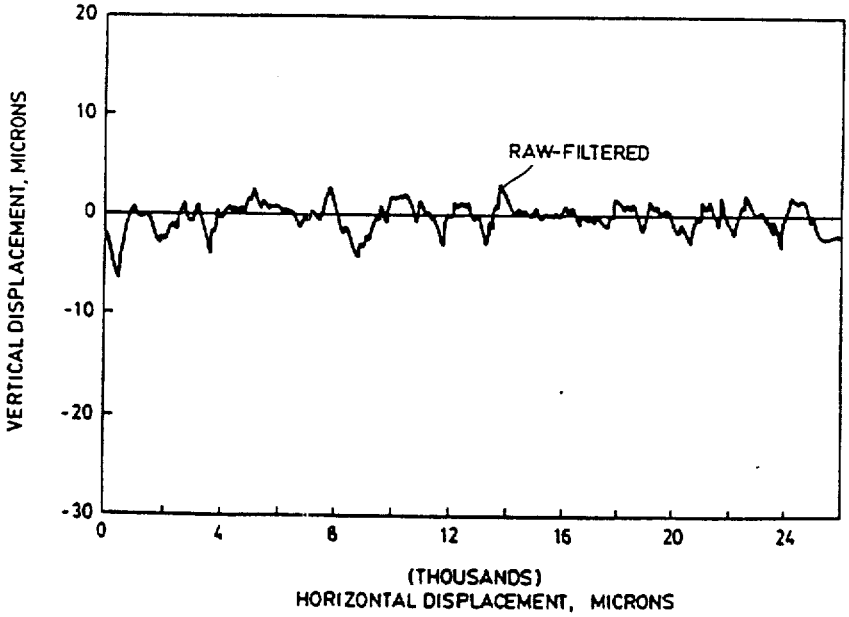
Figure 6:
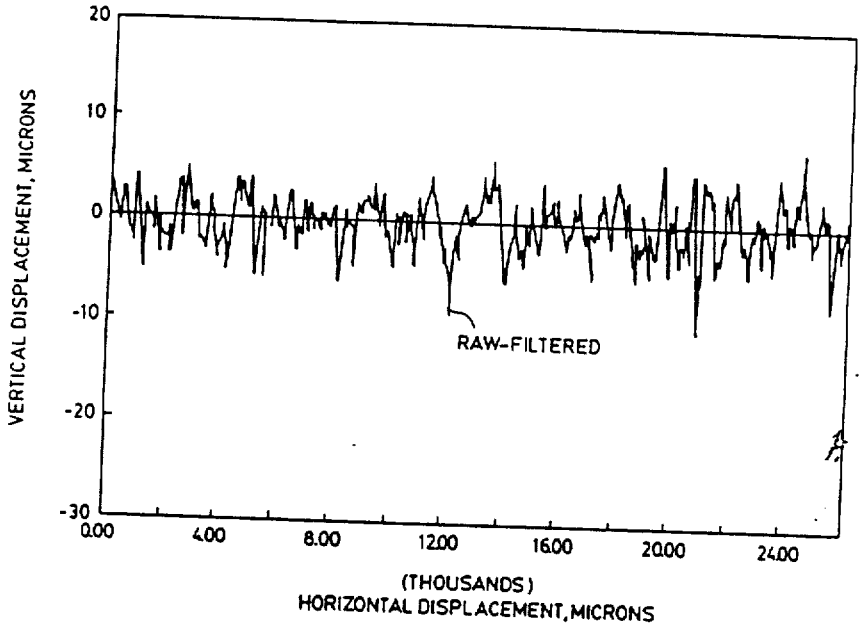
Figure 7:
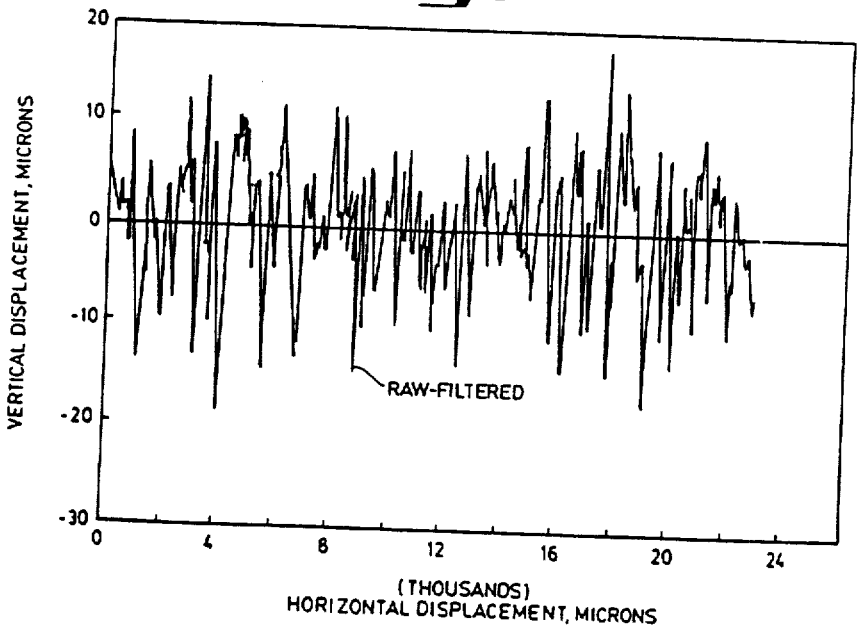
Figure 16:
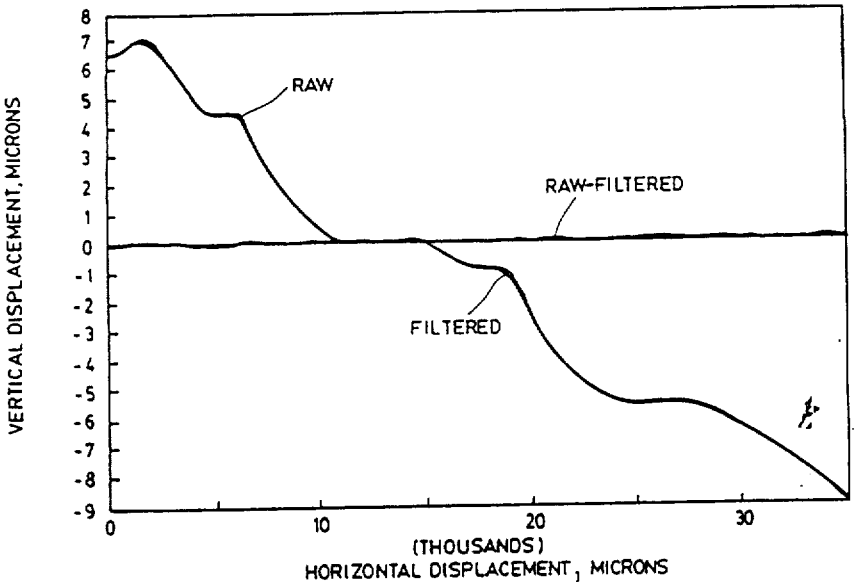
Figure 17:
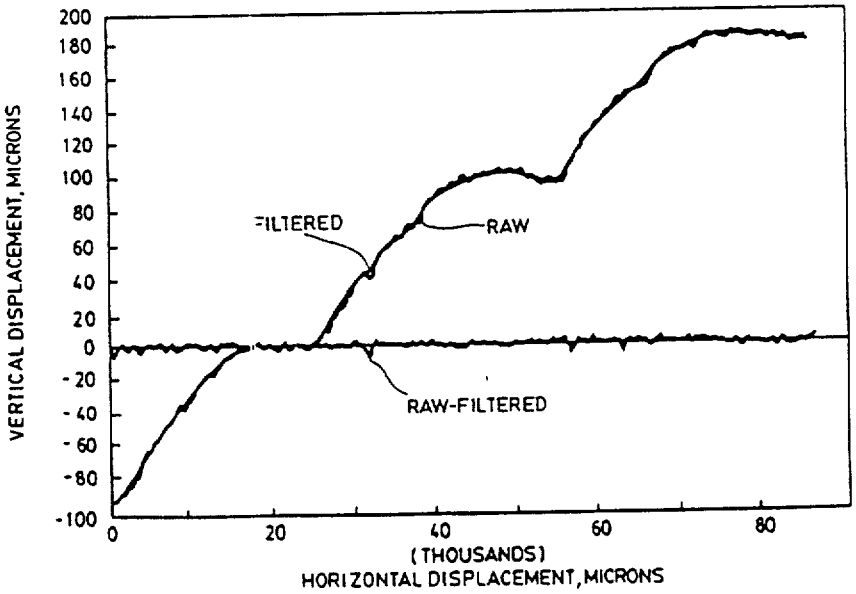
Figure 18:
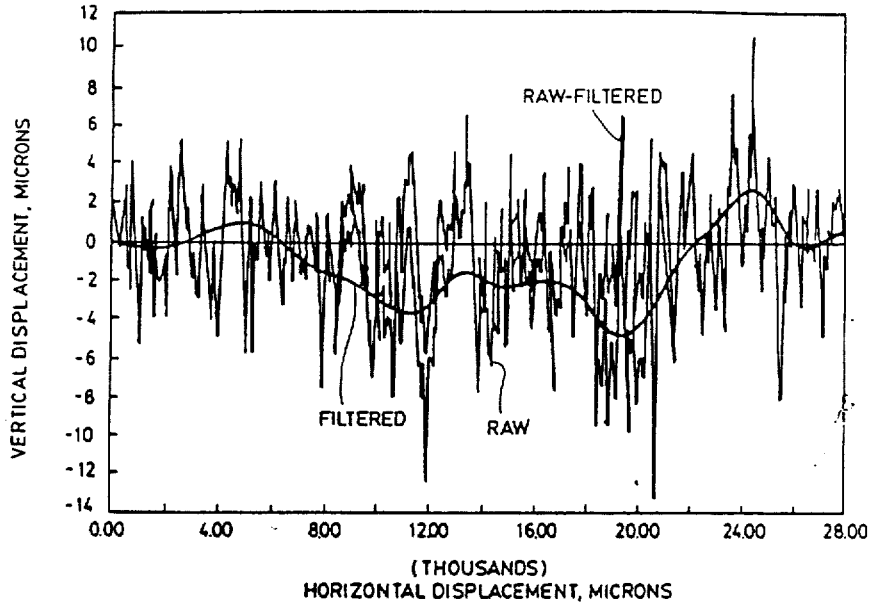
Figure 19:
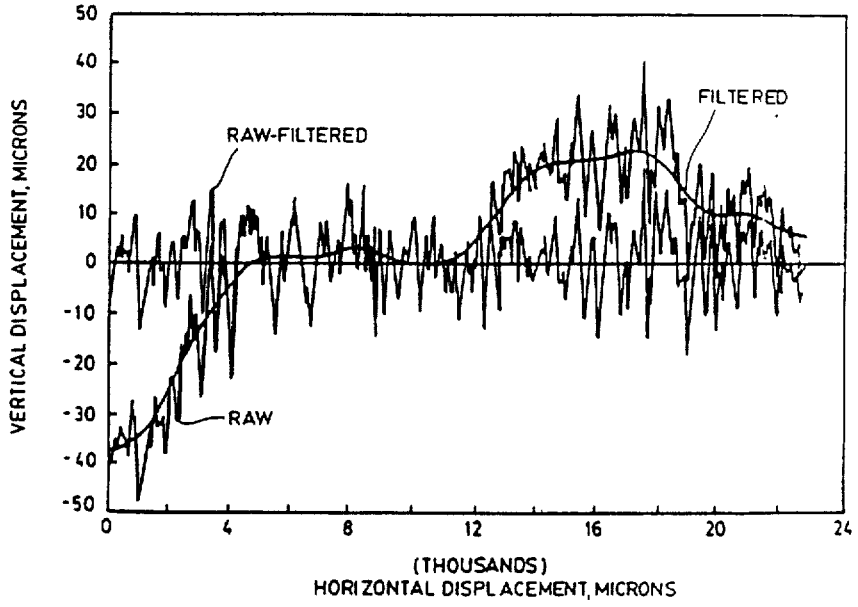

The data shown in FIGS. 9, 11, 13 and 14 was measured using the test apparatus shown in FIG. 21.

The test apparatus shown in FIG. 21 measures the surface impedance and operating temperature of a susceptor 30 under high power microwave radiation conditions similar to those in a microwave oven.

The source of microwave radiation 32 comprises a conventional half wave voltage doubler microwave oven power supply 31 with the addition of a variac in the anode high voltage supply circuit 31. The attenuated output of the source 32 is applied to the susceptor 30 via the waveguide system 33 shown in FIG. 21. The apparatus can apply an incident power of up to 125 watts to the susceptor sample 30. The rate of susceptor temperature rise is determined by the incident power which can be adjusted to allow accurate tracking of the surface temperature by a thermometric device 34.

Figure 22:
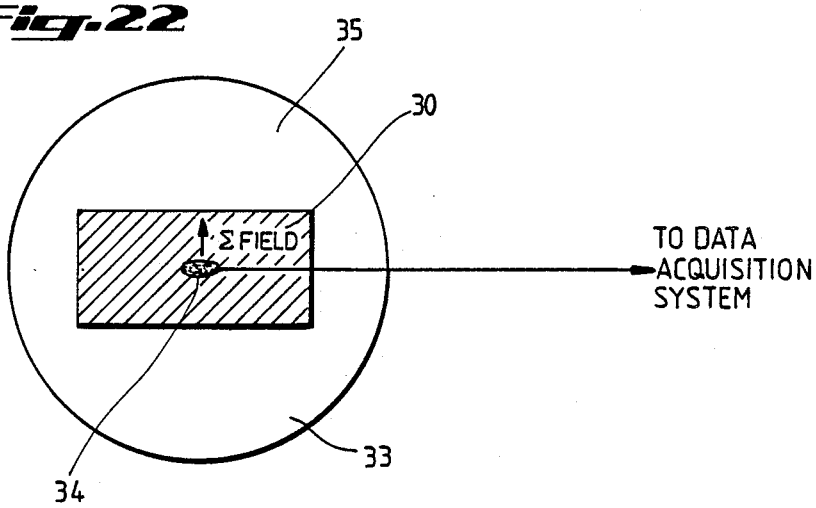
FIG. 22 is a cross-sectional view of a susceptor sample mounted on waveguide.

The susceptor sample 30 is cut to be larger than the inside dimensions of the waveguide 33 and then mounted on the waveguide flange 35. A conventional thermocouple 34 is attached to the center of the susceptor 30 by silicone grease as shown in FIG. 22. The thermocouple wire 34 is routed so as to be perpendicular to the electric field in the waveguide 33 to avoid atypical local overheating near the tip 34. A Luxtron thermometric device with remote sensing phosphor painted to the susceptor surface has also been used with similar results. The susceptor sample 30 with attached thermocouple 34 is then clamped between the flange 35 and a corresponding flange on a one quarter wavelength long shorted waveguide 33. The guide 33 is thus terminated in the impedance of the susceptor at the location of the susceptor 30.

After calibration, a dual directional coupler 36 in conjunction with a network analyzer 37 measures the real 40 and imaginary 41 parts (denoted as R and I in the drawing) of the reflection coefficient seen at the reference plane 38 defined by the waveguide flange 35 where the susceptor 30 is mounted. The impedance at the reference plane 38 is easily computed from the complex reflection coefficient. This impedance is the surface impedance of the susceptor 30. From the surface impedance, the power absorbed in, reflected from, and transmitted through the susceptor 30 may be computed for a wide variety of other circumstances.

A blanking pulse 39 from the network analyzer 37 is used to suppress collection of invalid data occurring when the network analyzer 37 is not in phase lock with the pulsed microwave output of the magnetron 32.

SUMMARY OF ADVANTAGES OF THE INVENTION

The present invention provides a susceptor which has dimensional stability and structural integrity during microwave heating without requiring additional laminated layers. The degree of breakup of the thin metal film can be adjusted. Thus, the susceptor is more responsive to the heating effects of microwave radiation, and is responsive for a longer period of time during microwave heating, than is the case with a conventional susceptor formed from a metallized layer of polyester which may be adhesively bonded to the a supporting layer.

The present invention further provides the advantage of simplicity and economy of manufacture. The paper substrate which is used for the susceptor may form an integral part of the package material. In other words, the thin film of metal may be applied to paperboard which forms part of a carton or tray.

The inherent structural integrity and dimensional stability of the susceptor constructed in accordance with the present invention eliminates the need for additional manufacturing processes to provide additional dimensional support for the susceptor. Lamination to a structural reinforcing member is not required.

The present invention provides the ability to withstand higher temperatures without adverse consequences such as melting. Paper substrates can withstand substantially more heat than commonly used polyester films. A paper substrate is not subject to shrinking during heating as is the case with conventional biaxially oriented polyester sheets.

By using appropriate thicknesses of metal layers and smoothness of the paper substrate surface in accordance with the present invention, elimination of arcing as a mode of failure may be achieved. The paper substrate characteristics, the thickness of the metal film, and the composition of the metal can be selected to obtain useful heating performance without arcing.

The present invention further provides the advantage of coating both sides of a paper substrate to improve microwave heating performance. Higher heating rates may be bbtained without incurring problems of arcing. In some cases, a higher reflection percentage can be maintained throughout the heating cycle. The achievement of higher reflection and absorption without arcing is a significant advantage.

Because the present invention utilizes a thin film of metal which is deposited directly on a paper substrate, the use of adhesives to laminate layers together to form a substrate may be avoided. It is not necessary to have adhesives in direct contact with the thin metal film.

The above disclosure has been directed to a preferred embodiment of the present invention. The invention may be embodied in a number of alternative embodiments other than those illustrated and described above. A person skilled in the art will be able to conceive of a number of modifications to the above described embodiments after having the benefit of the above disclosure and having the benefit of the teachings herein. The full scope of the invention shall be determined by a proper interpretation of the claims, and shall not be necessarily limited to the specific embodiments described above.

What is claimed is:

1. A susceptor for heating food in a microwave oven, comprising:

a paper substrate;

a thin film of metal deposited directly on the paper substrate; and, the thin film of metal being applied to a surface of the paper substrate in a thickness selected such that the combination produces a susceptor having a complex impedance measured at the frequency of a microwave oven which has a resistive component between about 30 ohms per square resistive and about 3500 ohms per square resistive, the susceptor being operative to heat responsive to microwave radiation.

2. A susceptor for heating food in a microwave oven, comprising:

a sheet of paper forming a dimensionally stable paper substrate, the paper substrate having a surface; and, a thin film of metal deposited directly on the surface of the paper substrate, the thin film of metal having a thickness between about 50 Angstroms and about 600 Angstroms, the thin film of metal being operable to heat when exposed to microwave radiation.

3. A susceptor for heating food in a microwave oven, comprising:

a dimensionally stable paper substrate having a thin film of metal deposited directly on a surface thereof, the thin film of metal having a thickness, the surface of the paper substrate and the thickness of the thin film of metal being selected so that the susceptor heats responsive to microwave radiation without substantial arcing and maintains structural integrity during heating.

4. A susceptor for heating food in a microwave oven where the microwave oven has a predetermined microwave frequency, comprising:

a dimensionally stable paper substrate; and, a thin film of metal deposited directly on the paper substrate, the thin film of metal having a complex impedance measured at the microwave frequency of the microwave oven, the real component of the complex impedance being a surface resistance Rs, the thin film of metal having a thickness "t" which may be approximately related to the surface resistance by the following formula:

$$Rs = C/s_f(t - to)$$

where "$s_f$" is the film conductivity corrected for mean free path effects, "t" is the total thickness of the metal film deposited on the paper substrate, "to" is the thickness of metal that must be deposited on the paper substrate before the deposition of more metal has an observable electrical effect at a predetermined microwave frequency and is a function of surface roughness AA of the paper substrate, and "C" is a function of surface roughness AA for the metal and determinable empirically using least-squares curve fitting.

5. The susceptor according to claim 4, wherein: the metal is aluminum, and "C" is as follows:

$$C=13.7(AA)+2.46$$

where "AA" is the arithmetic average surface roughness of the paper substrate.

6. The susceptor according to claim 5, wherein: the thickness "to" is as follows:

$$to=12.6(AA)+65.4$$

where "AA" is the arithmetic average surface roughness of the paper substrate.

7. The susceptor according to claim 4, wherein: the metal is aluminum, and the thickness "to" is as follows:

$$to=12.6(AA)+65.4$$

where "AA" is the arithmetic average surface roughness of the paper substrate.

8. A susceptor for heating food in a microwave oven, the microwave oven having a predetermined microwave frequency, comprising:

a microwave stable paper substrate;

a thin film of metal deposited directly on the paper substrate; and, the composite structure defined by the paper substrate and thin film of metal deposited thereon having a complex impedance measured at the microwave frequency of the microwave oven prior to microwave heating, the real part of the complex impedance being a resistive component, the resistive component having a value greater than or equal to 30 ohms per square, and having a value less than 35,000 ohms per square.

9. The susceptor according to claim 8, wherein: the thin film of metal comprises aluminum.

10. The susceptor according to claim 8, wherein: the resistive component is greater than 125 ohms per square.

11. The susceptor according to claim 9, wherein:

the resistive component is greater than 125 ohms per square.

12. The susceptor according to claim 8, claim 9, or claim 10, wherein:

the resistive component is less than 14,500 ohms per square.

13. The susceptor according to claim 8, claim 9, or claim 10, wherein:

the resistive component is less than 7,000 ohms per square.

14. The susceptor according to claim 8, claim 9, or claim 10, wherein:

the resistive component is less than 4,500 ohms per square.

15. The susceptor according to claim 8, claim 9, or claim 10, wherein:

the resistive component is less than 3,300 ohms per square.

16. The susceptor according to claim 8, claim 9, or claim 10, wherein:

the resistive component is less than 2,000 ohms per square.

17. A susceptor for heating food in a microwave oven, the microwave oven having a predetermined microwave frequency, comprising:

a microwave stable paper substrate;

a thin film of metal deposited directly on the paper substrate; and, the composite structure defined by the paper substrate and thin film of metal deposited thereon having an absorption measured with a network analyzer at the microwave frequency of the microwave oven prior to microwave heating, the absorption being greater than one percent.

18. The susceptor according to claim 17, wherein: the absorption is greater than 2.5 percent.

19. The susceptor according to claim 17, wherein: the absorption is greater than 5 percent.

20. The susceptor according to claim 17, wherein: the absorption is greater than 7.5 percent.

21. The susceptor according to claim 17, wherein: the absorption is greater than 10 percent.

22. A susceptor for heating food in a microwave oven, the microwave oven having a predetermined microwave frequency, comprising:

a microwave stable paper substrate;

a thin film of stainless steel deposited directly on the paper substrate; and, the composite structure defined by the paper substrate and thin film of stainless steel deposited thereon having a complex impedance measured at the microwave frequency of the microwave oven prior to microwave heating, the real part of the complex impedance being a resistive component, the resistive component having a value greater than 60 ohms per square, and having a value less than 7,000 ohms per square.

23. The susceptor according to claim 22, wherein:

the resistive component is greater than 300 ohms per square and less than 5,000 ohms per square.

24. A susceptor for heating food in a microwave oven, comprising:

a microwave stable paper substrate; and, a thin film of stainless steel deposited directly on the paper substrate, the thin film of stainless steel having a thickness between 50 Angstroms and 3,500 Angstroms.

25. The susceptor according to claim 22, claim 23, or claim 24, wherein:

the thin film of stainless steel has a thickness between 100 Angstroms and 3,000 Angstroms.

26. A susceptor for heating food in a microwave oven, comprising:

a microwave stable substrate having an arithmetic average surface roughness "AA" greater than 0.2 microns; and, a thin film of metal deposited directly on the substrate, the thin film of metal being operative to heat responsive to microwave radiation.

27. A susceptor for heating food in a microwave oven, comprising:

a microwave stable substrate having an arithmetic average surface roughness "AA" greater than 0.2 microns; and, a thin film of metal deposited directly on the substrate, the thin film of metal comprising aluminum, the thin film of metal having a thickness between 50 Angstroms and 600 Angstroms.

28. A susceptor for heating food in a microwave oven, comprising:

a microwave stable substrate having an arithmetic average surface roughness "AA" greater than 0.2 microns; and, a thin film of metal deposited directly on the substrate, the thin film of metal comprising stainless steel, the thin film of metal having a thickness between 50 Angstroms and 3,500 Angstroms.

29. The susceptor according to claim 28, wherein:

the thin film of metal has a thickness between 100 Angstroms and 3,000 Angstroms.

30. The susceptor according to claim 26, claim 27, claim 28, or claim 29, wherein:

the substrate has an arithmetic average surface roughness "AA" greater than 0.5 microns.

31. The susceptor according to claim 30, wherein:

the substrate has an arithmetic average surface roughness "AA" greater than 1 micron.

32. A susceptor for heating food in a microwave oven, comprising:

a microwave stable paper substrate, the paper substrate having a top side and a bottom side;

a thin film of metal deposited directly on the top side of the paper substrate, the thin film of metal being operative to heat responsive to microwave radiation; and, a thin film of metal deposited directly on the bottom side of the paper substrate, said thin film of metal being operative to heat responsive to microwave radiation.

* * * * *

UNITED STATES PATENT AND TRADEMARK OFFICE

CERTIFICATE OF CORRECTION

PATENT NO. : 4,970,360

DATED : November 13, 1990

INVENTOR(S) : Peter S. Pesheck et al.

It is certified that error appears in the above—identified patent and that said Letters Patent is hereby corrected as shown below:

In the Abstract, line 4, "Substrate" should be -- Substrates --.

In the Drawings, please substitute the attached drawings for Figures 4, 5, 6, 7, 16, 17, 18, and 19.

Column 3, line 49, "Dektrak" should be -- Dektak --; line 52, "Dektrak" should be -- Dektak --.

Column 6, line 40, "unto" should be -- onto --.

Column 8, line 24 "susceptor" should be -- susceptors --.

Column 9, line 14 of Table II, "CLAY COATED SIDE OF OVENABLE" should be -- CLAY COATED SIDE OF OVENABLE PAPERBOARD --; line 15, of Table II, "PAPERBOARD BOPET" should be -- BOPET --.

Column 9, line 18, "Substrates" should be -- substrates --; line 47 "data points" should be -- measurements --.

Column 19, line 33, delete "the".

Signed and Sealed this

Second Day of June, 1992

*Attest:*

DOUGLAS B. COMER

*Attesting Officer*

*Acting Commissioner of Patents and Trademarks*